US011309141B2

(12) United States Patent
Nishide et al.

(10) Patent No.: US 11,309,141 B2
(45) Date of Patent: Apr. 19, 2022

(54) DC HIGH VOLTAGE RELAY AND CONTACT MATERIAL FOR DC HIGH-VOLTAGE RELAY

(71) Applicant: TANAKA KIKINZOKU KOGYO K.K., Tokyo (JP)

(72) Inventors: Sachihiro Nishide, Tomioka (JP); Tetsuya Nakamura, Tomioka (JP); Hiroyuki Itakura, Tomioka (JP); Nobuhito Yanagihara, Tomioka (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 0 days.

(21) Appl. No.: 16/980,047

(22) PCT Filed: Mar. 12, 2019

(86) PCT No.: PCT/JP2019/009841
§ 371 (c)(1),
(2) Date: Sep. 11, 2020

(87) PCT Pub. No.: WO2019/176891
PCT Pub. Date: Sep. 19, 2019

(65) Prior Publication Data

US 2021/0012977 A1 Jan. 14, 2021

(30) Foreign Application Priority Data

Mar. 16, 2018 (JP) ..... JP2018-050054

(51) Int. Cl.
*H01H 1/0237* (2006.01)
*H01H 50/58* (2006.01)

(52) U.S. Cl.
CPC ..... *H01H 1/0237* (2013.01); *H01H 50/58* (2013.01)

(58) Field of Classification Search
USPC ..... 335/196
See application file for complete search history.

(56) References Cited

U.S. PATENT DOCUMENTS

2012/0175148 A1 7/2012 Inaba et al.
2016/0064157 A1 3/2016 Kuroda et al.

FOREIGN PATENT DOCUMENTS

DE 11 2013 007 018 T5 1/2016
JP H08-269640 A 10/1996
(Continued)

OTHER PUBLICATIONS

International Searching Authority, "International Search Report," issued in connection with International Patent Application No. PCT/JP2019/009841, dated Jun. 4, 2019.
(Continued)

*Primary Examiner* — Toan T Vu
*Assistant Examiner* — Xuan Ly
(74) *Attorney, Agent, or Firm* — Foley & Lardner LLP

(57) ABSTRACT

A DC high-voltage relay including at least one contact pair including a movable contact and a fixed contact, having a contact force and/or opening force of 100 gf or more, the DC high-voltage relay of 48 V or more. The movable contact and/or the fixed contact includes Ag oxide-based contact material. Metal components in the contact material includes at least one metal M essentially containing Sn, and a balance including Ag and inevitable impurity metals. The content of the metal M is 0.2% by mass or more and 8% by mass or less based on the total mass of all metal components in the contact material. The contact material has a material structure in which one or more oxides of the metal M are dispersed in a matrix including Ag or a Ag alloy. As metal M, In, Bi, Ni and Te can be added.

18 Claims, 6 Drawing Sheets

(56) References Cited

FOREIGN PATENT DOCUMENTS

| | | | | |
|---|---|---|---|---|
| JP | H08269640 | | * | 10/1996 |
| JP | 2005-120427 | A | | 5/2005 |
| JP | 2005120427 | | * | 5/2005 |
| JP | 2005-294126 | A | | 10/2005 |
| JP | 2005294126 | | * | 10/2005 |
| JP | 2012-003885 | A | | 1/2012 |

OTHER PUBLICATIONS

International Searching Authority, "Written Opinion," issued in connection with International Patent Application No. PCT/JP2019/009841, dated Jun. 4, 2019.
Extended European Search Report dated Mar. 26, 2021 for corresponding European Patent Application No. 19766846.0.

* cited by examiner

EXAMPLE 4

EXAMPLE 6

EXAMPLE 8

COMPARATIVE EXAMPLE 2

| VOLTAGE | LOAD CURRENT | NUMBER OF OPERATIONS | SWITCHING CYCLE |
|---|---|---|---|
| **DC20V** | INRUSH 80 A / INTERRUPTION 1 A | 100,000 TIMES | **1sON/9sOFF** |

DC HIGH VOLTAGE RELAY AND CONTACT MATERIAL FOR DC HIGH-VOLTAGE RELAY

RELATED APPLICATIONS

The present application claims priority under 37 U.S.C. § 371 to International Patent Application No. PCT/JP2019/009841, filed Mar. 12, 2019, which claims priority to and the benefit of Japanese Patent Application No. 2018-050054, filed on Mar. 16, 2018. The contents of these applications are hereby incorporated by reference in their entireties.

TECHNICAL FIELD

The present invention relates to a DC high-voltage relay (contactor) which performs on/off control of a DC high-voltage circuit. Specifically, the present invention relates to a DC high-voltage relay having a low-heat-generation property during continuous feeding of a current, and reliable circuit interruption performance in contact opening. The present invention also relates to a contact material which is applied to the DC high-voltage relay.

BACKGROUND ART

DC high-voltage relays are used for control of power source circuits and charging circuits of cars having high-voltage batteries, such as hybrid vehicles (HVs), plug-in hybrid vehicles (PHVs) and electric vehicles (EVs), and high-voltage circuits such as those of power conditioners of electrical storage devices in power supply systems such as solar power generation equipment. For example, in the hybrid vehicle or the like, a DC high-voltage relay called a system main relay (SMR) or a main contactor is used. The DC high-voltage relay is similar in basic structure and functions to a DC low-voltage relay which has heretofore used for general automotive applications. It is to be noted that the DC high-voltage relay is a device corresponding to relatively new applications such as the above-described hybrid vehicles and the like, and has differences associated with the applications, and particular problems caused by the differences.

Conventional DC low-voltage circuits will now be described. In the DC low-voltage circuit, a rated voltage and a rated current are clearly specified. For the rated voltage, for example, in a car, a nominal voltage of a battery mounted is DC 12 V, and this nominal voltage is a rated voltage of a general in-vehicle universal relay. DC 24 V batteries are mounted in some trucks and buses, and therefore some relays have a rated voltage of DC 24 V. In this way, a DC low-voltage relay in which the rated voltage and the rated current are clearly specified allows upper limits of a fed current and a load to be relatively easily predicted. Thus, in the DC low-voltage relay, it is necessary that a contact material be improved so as to exhibit durability against a predicted electric power amount and load. For conventional DC low-voltage relays, reduction in size and weight tends to be required for in-vehicle applications and the like. Reduction in size and weight of DC low-voltage relays can be achieved by reduction in size and weight of constituent components, but a burden on the contact material is accordingly increased. Thus, this requirement is met by improvement of durability (i.e. wear resistance and welding resistance) of the contact material.

Here, Ag oxide-based contact materials have been widely used as contact materials for conventional DC low-voltage relays. The Ag oxide-based contact material means a material in which an oxide of a metal such as Sn, In or the like ($SnO_2$, $In_2O_3$ or the like) is dispersed in a Ag matrix or a Ag alloy matrix. In the Ag oxide-based contact material, performance of the contact material is improved by a dispersion enhancing action on metal oxide particles to secure required properties such as wear resistance and welding resistance. For example, the present applicant discloses a Ag oxide-based contact material in Patent Document 1 as a contact material which is applied to in-vehicle DC low-voltage relays.

In improvement of conventional DC low-voltage relays, the amount of oxides in the Ag oxide-based contact material to be applied is increased. This is because in general, in a contact material utilizing a dispersion enhancing action of oxides, welding resistance and wear resistance improves with increased amount of the oxides by enhancing the concentration of metal components that form the oxides. Specifically, Ag oxide-based contact materials are often used in which the amount of metal components other than Ag, such as Sn and In, is 10% by mass or more. This is because when the amount of metal components other than Ag in the contact material is less than 10% by mass, there are cases where the amount of oxides is small, so that required properties are not obtained because of defects such as welding, dislocation and wear. Thus, in DC low-voltage relays, improvement of durability within a specified rated voltage range and securement of durability in reduction in size and weight are achieved by improving Ag oxide-based contact materials as described above.

RELATED ART DOCUMENT

Patent Document

Patent Document 1: JP 2012-3885 A

SUMMARY OF THE INVENTION

Problems to be Solved by the Invention

On the other hand, in DC high-voltage relays, a rated voltage and a rated current are not clearly specified at present. For DC high-voltage relays, required specifications will significantly depend on improvement of battery performance in future. That is, in DC high-voltage relays, it is difficult to predict the upper limit of a load on contacts, and the load will likely increase in future. In this respect, DC high-voltage relays are different from conventional ones.

It is certain that in DC high-voltage relays, a voltage and a current will be further increased in future. This is evident from a tendency to improve battery performance and enhance power of drive motors in recent years. For such DC high-voltage relays, problems of heat generation and welding at contacts due to an increase in fed current are more strongly pointed out.

With regard to the problem of heat generation, the amount of heat generation is proportional to a square of current and a contact resistance value, and therefore it is supposed that a considerable amount of heat will be generated due to a future increase in current in DC high-voltage relays. Abnormal heat generation in relays may cause fatal problems such as firing and fire damage in a worst-case situation.

In DC high-voltage relays, the problem of welding of contacts is not less important than the problem of heat generation. Welding is a phenomenon in which contact surfaces of a contact pair are melted and firmly fixed to each other by Joule heat during feeding of a current and arc heat in arc discharge occurring in switching. Such welding of contacts hinders opening of the contact pair, and causes return failure and breakdown of an overall circuit. Particularly, in high-voltage circuits, the breakdown may lead to a serious disaster, and therefore DC high-voltage relays are required to perform reliable circuit interruption. For example, when a system malfunction occurs in a DC high-voltage circuit of a hybrid vehicle or the like, it is necessary that a relay be turned off to interrupt the circuit. An interrupting current in such a case is larger than a current in normal switching. Thus, it is necessary for DC high-voltage relays to be free from welding problems so that contacts exhibit interruption performance at the time of abnormality.

For coping with the problems of heat generation and welding at contacts in DC high-voltage relays as described above, measures with respect to structures and mechanisms of the DC high-voltage relays are taken. For example, a contact area is secured by strengthening a contact pressure spring to enhance a contact force between a movable contact and a fixed contact, and contact resistance between both the contacts is reduced to suppress heat generation. Enhancement of the contact force also contributes to prevention of firing and breakage of the relay when the DC high-voltage circuit is short-circuited.

Further, in DC high-voltage relays, a structure is often adopted for eliminating arc discharge occurring between contacts. Specifically, measures such as securement of a sufficient gap between contacts, placement of a magnet for extinguishing an arc and strengthening of a magnetic force of the magnet. In addition, the relay is turned into a hermetically sealed structure, and hydrogen gas, nitrogen gas or a mixed gas thereof is introduced into the relay to more quickly eliminate an arc by an arc cooling effect.

However, the above-described measure with respect to structures and mechanisms causes size increase of a relay body depending on a magnitude of a volume in required specifications. Hence, reduction in size and weight which is a persistent need from a market is not satisfied only with the above-mentioned measures. Therefore, in DC high-voltage relays, measures with respect to structures and mechanisms are important, but it is preferable that in addition to these measures, measures against heat generation and welding with respect to contacts themselves are taken.

Heretofore, Ag oxide-based contact materials have been often applied to DC high-voltage relays as with conventional DC low-voltage relays. However, for DC high-voltage relays to adapt to an increase in voltage and current, there is a limit to Ag oxide-based contact materials having the same range of compositions as before. In this respect, in conventional DC low-voltage relays, a durability life is improved by enhancing the concentration of metal components other than Ag in a contact material to increase the amount of oxides.

In DC high-voltage relays, however, an increase in amount of oxides in the contact material is not preferable from the viewpoint of contact resistance. While Ag is a metal having a high electrical conductivity, a metal oxide is a resistor which reduces an electrical conductivity of the overall contact material. An increase in amount of oxides leads to an increase in resistance value of the overall contact material. In addition, when the amount of oxides increases, an aggregate layer of oxides easily forms on a surface of a damaged portion generated when arc discharge occurs in contact switching. This also causes an increase in contact resistance value of the contact material.

As described above, the amount of heat generation at contacts is proportional to a square of current and contact resistance. An increase in amount of oxides, which elevates contact resistance of the contact material of a DC high-voltage relay whose voltage and current are increased, should be avoided from the viewpoint of suppression of heat generation and welding. In this respect, examples of studies on various contact materials for DC high-voltage relays, which have been conducted up to now, are only an extension of studies on materials for general switching contacts. There are few examples of reports for practical application to DC high-voltage relays. p The present invention has been made against the backgrounds as described above, and provides a DC high-voltage relay such as a system main relay, which is capable of performing reliable on/off control while coping with problems of heat generation and welding at contacts. With respect to the problems, it is necessary that a contact material which stably exhibits a low contact resistance value be applied to contacts for the DC high-voltage relays. The present invention provides a contact material suitable for the DC high-voltage relay with consideration given to characteristics of the DC high-voltage relay.

Means for Solving the Problems

Since the above-described problems of the present invention are attributable to a contact portion of a DC high-voltage relay, optimization of a Ag oxide-based contact material forming a contact may be involved in a greater or lesser degree for solving the problems. Increasing the amount of oxides has been heretofore considered to be an appropriate measure, but of course, for the DC high-voltage relay, this measure cannot be adopted without any careful consideration. This is because an increase in amount of oxides leads to an increase in heat generation due to elevation of contact resistance.

In this respect, for conventional DC low-voltage relays, there are few cases where rise of contact resistance due to an increase in amount of oxides causes a fatal problem. In conventional DC low-voltage circuits, a rated voltage and a rated current are low, and are clearly specified. Thus, an advantage from a welding preventing effect due to improvement of durability overcomes a disadvantage from heat generation due to an increase in amount of oxides.

Accordingly, the present inventors gave attention to a characteristic of a DC high-voltage relay before studies on a configuration of a contact material. The characteristic of the DC high-voltage relay is strength of a contact force and an opening force between a fixed contact and a movable contact.

In general, in relays (including contacts having equivalent functions and configurations), an electromagnet or a coil and an optional biasing unit jointly control contact and separation between the fixed contact and the movable contact to perform feeding a current to a circuit and interruption of a circuit (on/off). Examples of the optional biasing unit include contact pressure springs and return springs for plunger-type relays, and movable springs and restoration springs for hinge-type relays. Such mechanisms for control of the fixed contact and the movable contact are the same throughout relays independent from the rated voltage.

However, in DC high-voltage relays such as system main relays, the contact force and the opening force between the fixed contact and the movable contact are often set to be high. Specifically, the contact force and the opening force are often set to about 10 gf to 50 gf in general DC low-voltage relays, whereas the contact force or the opening force is often set to 100 gf or more in DC high-voltage relays. The contact force in the DC high-voltage relay is high with the aim of reducing contact resistance of the contact to suppress heat generation. The contact force influences a contact area between contacts, and when the contact force is increased, contact resistance can reduce to suppress generation of Joule heat, and a reducing effect on melting and welding of contact surfaces is exhibited. On the other hand, the opening force means a return force for returning the contact to a separation position. In DC high-voltage relays, the opening force tends to increase with an increase in contact force for smoothly performing switching operations of contacts.

The reason why interruption failure occurs due to welding of contacts at switching contacts is that the fixed contact and the movable contact are firmly fixed to each other due to welding, so that the contacts cannot be separated with a set opening force. For conventional DC low-voltage relays in which ratings and specifications are clearly specified, there is the upper limit on setting of the contact force and the opening force, and set values of the forces are not so large. Thus, in conventional DC low-voltage relays, reduction in size and weight is prioritized, and a low contact force and opening force are set, so that the problem of welding easily appears. Welding in this case is difficult to resolve with properties of the relay. Thus, it has been hoped to cope with the problem with properties of the contact material, and the contact material has been required to have strict welding resistance.

On the other hand, for DC high-voltage relays in which a high contact force and opening force are set, the fixed contact and the movable contact may be separated from each other even though these contacts are weldable to each other with heightened opening force. The present inventors considered that in a DC high-voltage relay to which the present invention is directed, it was possible to set welding resistance of a contact material more flexibly as compared to conventional DC low-voltage relays. Such an idea of allowing a certain degree of welding is unique in a field of switching contacts as well as DC high-voltage relays. DC high-voltage relays such as system main relays have become popular owing to development of high-voltage power sources in recent years, and are supposed to involve many unknown set items. Tolerance for welding resistance of the contacts is one of the items.

Given that welding resistance can be flexibly set, a property to be prioritized as the contact material of the DC high-voltage relay is a stable low contact resistance property. For reducing contact resistance of a Ag oxide-based contact material, reduction of the amount of oxides is effective. For the Ag oxide-based contact material, reduction of the amount of oxides leads to deterioration of welding resistance, but as described above, welding resistance can be flexibly set, and when a high contact force or opening force can be set, reduction of a considerable degree of welding resistance is allowable.

Of course, welding resistance is not always unnecessary for the contact material which is applied to the DC high-voltage relay. Although the contact force and the opening force can be set to be high, the contact force and the opening force cannot be unlimitedly increased because it is necessary to increase sizes of constituent components and a relay body for setting these forces to be high. With respect to required specifications, it is necessary to meet a need of size reduction in a market while solving the problems, and therefore a contact material to be applied is required to have a certain degree of welding resistance.

The present inventors conducted studies for finding a suitable oxide content in connection with reduction of contact resistance and welding resistance in order to discover a Ag oxide-based contact material applicable to a DC high-voltage relay having a predetermined contact force and opening force. AAg oxide-based contact material with the oxide content reduced to a predetermined range, with respect to conventional Ag oxide-based contact materials for general switching contacts, was discovered, and applied to arrive at the present invention.

For solving the above-described problems, the present invention provides a DC high-voltage relay including at least one contact pair including a movable contact and a fixed contact. The contact pair has a contact force and/or opening force of 100 gf or more. The DC high-voltage relay has a rated voltage of 48 V or more. The movable contact and/or the fixed contact includes a Ag oxide-based contact material. Metal components in the contact material include at least one metal M essentially containing Sn, and a balance including Ag and inevitable impurity metals. The content of the metal M is 0.2% by mass or more and 8% by mass or less based on a total mass of all metal components of the contact material. The contact material has a material structure in which one or more oxides of the metal M are dispersed in a matrix including Ag or a Ag alloy.

The DC high-voltage relay according to the present invention, and the contact material for the DC high-voltage relay will be described in detail below. In the contact material that is applied in the present invention, the content of oxides is specified based on the content of metal M which is a metal element other than Ag. The content of metal M is specified based on the total mass of all metal components forming the contact material. The contact material that is applied in the present invention is a Ag oxide-based contact material, and therefore constituent elements thereof include Ag, metal M, inevitable impurity metals, oxygen and non-metal inevitable impurity elements. However, in definition of metal components and inevitable impurity metals, elements categorized as semimetals, such as Te and Si, are treated as metals.

A. DC High-Voltage Relay of the Present Invention

The present DC high-voltage relay has a rated voltage of 48 V or more and a contact force or opening force of 100 gf or more as essential conditions. Other configurations and properties are the same as those of conventional DC high-voltage relays such as system main relays. Hereinafter, the above two essential conditions will be described, and also, configurations of the DC high-voltage relay which can be optionally provided will be described.

A-1. Rated Voltage

Relays having a rated voltage of less than 48 V, for example conventional DC low-voltage relays which cover a low voltage of 12 V to 24 V, cannot satisfy properties required for DC high-voltage relays such as system main relays. Application of the present invention to such conventional DC low-voltage relays has little significance. Hence, the DC high-voltage relay according to the present invention is targeted at a rated voltage of 48 V or more. The upper limit of the rated voltage of the DC high-voltage relay according to the present invention is preferably 3000 V. In addition, a rated current of DC high-voltage relay according to the present invention is assumed to be 10 A or more and 3000 A or less.

A-2. Contact Force and Opening Force of DC High-Voltage Relay of Invention

The present invention is directed to a DC high-voltage relay having a contact force or opening force of 100 gf or more. As described above, in the DC high-voltage relay of the present invention and the contact material mounted therein, welding resistance is flexibly set based on a relationship with the contact force or the opening force of the DC high-voltage relay that is applied. The intended DC high-voltage relay is one in which the contact force or the opening force is set to 100 gf or more between the movable contact and the fixed contact. A set value of 100 gf here is assumed to be the lower limit for meeting properties required for the DC high-voltage relay, and in this case, the contact material that is applied is required to have sufficient welding resistance. On the other hand, the upper limit of the contact force or the opening force is assumed to be 5000 gf. The contact force or the opening force is enhanced as sizes of constituent components and a relay body increase. However, it is desirable to design a relay whose contact force and opening force are as low as possible from the viewpoint of reduction in size and weight of the relay. According to the present invention, optimization of the contact material that is applied to the fixed contact and the movable contact enables setting of a DC high-voltage relay having a suitable contact force and opening force while suppressing heat generation and welding. Both the contact force and the opening force may be 100 gf or more. In addition, values of the contact force and the opening force are not required to be equal to each other.

The contact force or the opening force can be adjusted by volumes, sizes and the like of an electromagnet or a coil and an optional biasing unit which are constituent components of the relay as described later. Examples of the optional biasing unit include contact pressure springs and return springs for plunger-type relays, and movable springs and restoration springs for hinge-type relays.

A-3. Structure of DC High-Voltage Relay of Invention

The DC high-voltage relay according to the present invention can be characterized by the above-described rated voltage, contact force and opening force. Functions, configurations and mechanisms other than the rated voltage, the contact force and the opening force may be the same as those of conventional DC high-voltage relays. A structure and the like of the DC high-voltage relay according to the present invention will be described below.

A-3-1. Overall Structure and Constitutional Components of DC High-Voltage Relay

The DC high-voltage relay generally includes a drive section which generates and transmits a drive force for moving the movable contact; and a contact section which performs switching of the DC high-voltage circuit. The drive section includes an electromagnet or a coil which generates a drive force; a transmission unit (a plunger or an armature as described later) which transmits the drive force to the contact section; and a biasing unit (a spring such as a contact pressure spring, a return spring, a movable spring or a restoration spring) which biases the transmission unit for closing or opening the contact pair. The contact section includes the contact pair including a fixed contact and a movable contact which is moved by the transmission unit of the drive section; and a movable terminal bonded to the movable contact and a fixed terminal bonded to the fixed contact. The DC high-voltage relay is roughly classified into a plunger type and a hinge type based on a difference in physical configuration of the contact pair.

FIG. 1 is a diagram showing an example of a structure of the plunger-type DC high-voltage relay. The plunger-type relay drives a contact section by a plunger-shaped electromagnet to perform switching of a contact pair. The contact section of the plunger-type relay includes components, which are a movable contact, a fixed contact, a movable terminal and a fixed terminal. In addition, the drive section of the plunger-type relay includes an electromagnet, a movable iron core, a fixed iron core, a plunger as a transmission unit, and a contact pressure spring and a return spring as biasing units. The spring such as a contact pressure spring or a return spring is any one selected from a compression spring and a tension spring according to a relay structure. In addition, the plunger as a transmission unit is sometimes referred to as a movable iron core, a shaft or the like. The plunger-type relay may include ancillary components such as an electromagnetic repulsion suppressing yoke, an arc-extinguishing magnet (permanent magnet), a terminal cover, an electrode and a buffer spring (buffer rubber) in addition to the above-described components. Further, the DC high-voltage relay includes wiring connected to the circuit and wiring for controlling the electromagnet.

FIG. 2 is a diagram showing an example of a structure of the hinge-type DC high-voltage relay. The hinge-type relay means a relay in which an armature of an electromagnet rotates on a support point, so that a movable contact is driven directly or indirectly to perform switching of a contact pair. The contact section of the hinge-type relay includes components, which are a movable contact, a fixed contact, a movable spring (movable terminal) and a fixed terminal (fixed spring). The drive section of the hinge-type relay includes a coil, an iron core, a yoke, an armature as a transmission unit, and a return spring as a biasing unit. The spring such as a return spring is any one selected from a compression spring and a tension spring according to a relay structure. In addition, like the hinge-type relays in FIG. 2, some hinge-type relays include a contact drive card as a transmission unit, by which the contact is driven. The hinge-type relay may include ancillary components such as an arc-extinguishing magnet (permanent magnet), a terminal cover and an electrode in addition to the above-described components. Further, the DC high-voltage relay includes wiring connected to the circuit and a terminal and wiring for controlling the electromagnet.

In the DC high-voltage relay, an arc-extinguishing magnet is disposed near the contact pair of the contact section if necessary. The arc-extinguishing magnet extends arc discharge, which occurs between the movable contact and the fixed contact in opening of these contacts, with a Lorentz force to quickly extinguish the arc. The arc-extinguishing magnet is not involved in switching operations of the contact pair, and is not an essential component. However, the arc-extinguishing magnet is used in many products because it can exhibit a marked arc-extinguishing effect in the DC high-voltage relay. A time until completion of arc extinguishment is reduced as a magnetic flux density of the arc-extinguishing magnet increases. With regard to a type of the arc-extinguishing magnet, a ferrite magnet or rare earth magnet is selected in view of a balance between production cost and an operation design balance.

The various constituent components described above are stored in a case, a body or the like for shaping an overall device. The case or the body has an airtight structure which meets necessity of protecting a relay structure against external forces and preventing ingress of contaminants, dust and the like and ingress of outside air and gas. As the airtight structure of the DC high-voltage relay, an open-air type in which gaps at terminal portions, fitting portions and the like of the case are untreated, and a resin seal type in which the gaps are sealed with a seal material such as a resin are known. In addition, a cooling gas encapsulation type is known in which cooling gas such as hydrogen gas or nitrogen gas is encapsulated in a case having an airtight structure in which gaps are sealed. For the DC high-voltage relay according to the present invention, any of these airtight structures can be adopted.

A-3-2. Number of Contact Pairs

Like general relays, the DC high-voltage relay includes at least one contact pair including a movable contact and a fixed contact. The number of contact pairs can be one. However, in DC high-voltage relays such as system main relays, a double-break structure in which two contact pairs are provided is often adopted. The structure of the DC high-voltage relay shown in FIG. 1 is an example of the double-break structure. By adopting the double-break structure, a voltage is divided by two contact pairs to quickly extinguish the arc. An arc extinguishing effect is enhanced as the number of contact pairs increases. However, when there are an excessively large number of contact pairs, control becomes difficult. In addition, when a large number of contact pairs are set, much space is required. Thus, a DC high-voltage relay having a double-break structure is preferable for meeting demand for size reduction and the like.

A-3-3. Structure of Contact

In the DC high-voltage relay according to the present invention, a contact material as described later is applied for at least any one of the movable contact and the fixed contact of the DC high-voltage relay. At least any one of the movable contact and the fixed contact is bonded to the movable terminal and the fixed terminal. In a specific aspect, both the movable contact and the fixed contact are formed from the later-described contact material, and bonded to respective terminals, or any one of the movable contact and the fixed contact is formed from the later-described contact material, the other contact is formed from another contact material, and the contacts are bonded to respective terminals. Alternatively, the movable contact (or fixed contact) is formed from the later-described contact material, while for the fixed contact (or movable contact), the fixed terminal (or movable terminal) can be used as such with no contact material bonded. In the aspect of forming one contact from only the terminal, the contact acts as a movable contact or a fixed contact, and forms a contact pair.

Shapes and sizes of the movable contact and the fixed contact are not particularly limited. Examples of assumed shapes of the movable contact or the fixed contact include rivet contacts, chip contacts, button contacts and disc contacts. The movable contact and the fixed contact may be single materials formed of the later-described contact material, or may be cladded to another material. For example, the later-described contact material may be cladded to a base material formed of Cu or a Cu alloy, a Fe-based alloy and the like to obtain a movable contact and a fixed contact. There is no limit on a shape of a clad material, and various shapes such as tape-shaped contacts (clad tapes), crossbar contacts, rivet contacts, chip contacts, button contacts and disc contacts can be applied.

As constituent materials of the movable terminal and the fixed terminal, Cu or Cu alloys and Fe-based alloys are used. In addition, the terminals are subjected to surface treatment such as Sn plating, Ni plating, Ag plating, Cu plating, Cr plating, Zn plating, Pt plating, Au plating, Pd plating, Rh plating, Ru plating and Ir plating if necessary.

As a method for bonding the movable contact and the fixed contact to respective terminals, a processing method such as crimping, brazing or welding can be carried out. In addition, a part or the whole of a surface of the movable terminal and/or the fixed terminal may be covered with a contact material of later-described composition by surface treatment such as sputtering to obtain a movable contact and a fixed contact.

B. Constituent Material of Movable Contact and Fixed Contact (Contact Material of Invention)

In the DC high-voltage relay according to the present invention, a predetermined contact material is applied as a suitable constituent material of the movable contact and the fixed contact in view of exhibition of a high contact force and opening force.

That is, the contact material of the present invention is one for a DC high-voltage relay, the contact material being a Ag oxide-based contact material for forming at least a surface of a movable contact and/or a fixed contact of a DC high-voltage relay. The DC high-voltage relay has a rated voltage of 48 V or more, and a contact force and/or opening force of 100 gf or more at a contact pair. Metal components in the contact material include at least one metal M essentially containing Sn, and a balance including Ag and inevitable impurity metals. The content of the metal M is 0.2% by mass or more and 8% by mass or less based on a total mass of all metal components of the contact material. The contact material has a material structure in which one or more oxides of the metal M are dispersed in a matrix including Ag or a Ag alloy. A composition and a material structure of the contact material that is applied to the present invention, and a method for manufacturing the contact material will be described below.

B-1. Composition of Contact Material Applied in Invention

The contact material that is applied to the DC high-voltage relay of the present invention is a Ag oxide-based contact material having metal components including Ag, metal M and inevitable impurity metals. Metal M as a metal component is present as a constituent element of oxides dispersed in the matrix. The oxides are dispersed for improving mechanical properties and welding resistance of the contact material. As described above, welding resistance of the contacts is flexibly set for the DC high-voltage relay to which the present invention is directed. That is, reduction is welding resistance of the contact material itself is allowed as long as the contact force and/or the opening force of the DC high-voltage relay is set to be high. However, this does not mean that welding resistance is unnecessary. In the present invention, a certain degree of welding resistance is necessary, and therefore oxides are formed and dispersed. Hence, in the contact material that is applied in the present invention, metal M which is an essential metal element.

In the present invention, the content of metal M is 0.2% by mass or more and 8% by mass or less based on the total mass of all metal components in the contact material. When the content of metal M is less than 0.2% by mass, the amount of oxides dispersed is excessively small, so that mechanical strength and welding resistance may be reduced to a level substantially equal to that of pure Ag. Thus, interruption failure may occur depending on a set contact force or opening force. In addition, when the amount of oxides is excessively small, the contact material melts, so that a contact shape collapses. When the contact shape markedly collapses, normal contact between the movable contact and the fixed contact is not performed after return, and thus contact failure occurs. On the other hand, when the amount of oxides is more than 8% by mass, the contact material containing metal M has high contact resistance, so that a problem of heat generation in the DC high-voltage relay cannot be solved. In the present invention, the contents of Ag, metal M and inevitable impurity metals are specified in terms of a mass concentration based on the total mass of all metal components. The total mass of all metal components is a mass obtained by subtracting a mass of components other than metal components, such as oxygen and other gas components, from a mass of the overall contact material.

In addition, when a sufficiently high contact force or opening force is set in the DC high-voltage relay, proportionate reduction of welding resistance is permissible. In such a case, the content of metal M is preferably 0.2% by mass or more and 3% by mass or less from the viewpoint of contact resistance. On the other hand, when there is a limit on design of the contact force or the opening force of the DC high-voltage relay from the viewpoint of reduction in size and weight, it is necessary that a balance between welding resistance and contact resistance be more deliberately considered. In such a case, the content of metal M is preferably 3% by mass or more and 6% by mass or less.

The content of added metal (metal M) in the contact material for the DC high-voltage relay of the present invention as described above is intentionally made lower than the content of added metal in a contact material for a conventional general relay for automobile or the like. In the contact material (Ag oxide-based contact material) that is practically used for a general relay for automobile or the like, the content of metal components other than Ag (metal M in the present invention) is generally more than 10% by mass.

The Ag oxide-based contact material that is applied in the present invention essentially contains Sn as metal M. Sn is a metal which has been heretofore added as a constituent metal in the Ag oxide-based contact material, and consideration is given to a material strengthening action and a welding resistance improving action of an oxide of Sn ($SnO_2$). In the present invention, Sn is essential, and only Sn may be present as metal M. When only Sn is present as metal M, the contact material of the present invention contains Sn in an amount of 0.2% by mass or more and 8% by mass or less. When there is a limit on design of the contact force or the opening force, the content of Sn is preferably 3% by mass or more and 6% by mass or less.

The Ag oxide-based contact material that is applied in the present invention essentially has Sn, and may contain other metals as metal M. Specifically, the Ag oxide-based contact material may contain In, Bi, Ni and Te. These metals tend to exhibit an action of suppressing elevation of contact resistance through adjusting hardness of the Ag oxide-based contact material containing Sn. Amounts of these metals added will be described below. The above described effects are not obtained when the amount of each metal described below is less than the lower limit, and processability may deteriorate when the amount of each metal described below is more than the upper limit.

In is dispersed as an oxide of this element alone ($In_2O_3$). When the contact material contains In as metal M, the content of In is preferably 0.1% by mass or more and 5% by mass or less based on the total mass of all metal components in the contact material. The content of Sn is preferably 0.1% by mass or more and 7.9% by mass or less. When there is a limit on design of the contact force or the opening force, it is preferable that the content of In is 0.1% by mass or more and 3.1% by mass or less, the content of Sn is 2.8% by mass or more and 5.8% by mass or less, and the content of metal M is 6% by mass or less.

Bi is dispersed as an oxide of at least any one of an oxide of this element alone ($Bi_2O_3$) and a composite oxide with Sn ($Bi_2Sn_2O_7$). Bi is an added element useful for contact materials having Sn as metal M or contact materials having Sn and In as metal M. When the contact material contains Bi, the content of Bi is preferably 0.05% by mass or more and 2% by mass or less based on the total mass of all metal components in the contact material. The content of Sn is preferably 0.1% by mass or more and 7.95% by mass or less. When there is a limit on design of the contact force or the opening force, it is preferable that the content of Bi is 0.05% by mass or more and 2% by mass or less, the content of Sn is 2.9% by mass or more and 5.95% by mass or less, and the content of metal M is 6% by mass or less. The content of In which is optionally present is preferably 0.1% by mass or more and 5% by mass or less.

Te is dispersed as an oxide of this element alone ($TeO_2$). Te is an added element useful for contact materials having Sn as metal M or contact materials having Sn and In as metal M. When the contact material contains Te as metal M, the content of Te is preferably 0.05% by mass or more and 2% by mass or less based on the total mass of all metal components in the contact material. The content of Sn is preferably 0.1% by mass or more and 7.95% by mass or less. The content of In which is optionally present is preferably 0.1% by mass or more and 5% by mass or less. When there is a limit on design of the contact force or the opening force, it is preferable that the content of Te is 0.05% by mass or more and 2% by mass or less, the content of Sn is 2.8% by mass or more and 5.8% by mass or less, and the content of metal M is 6% by mass or less. In this case, the content of In which is optionally present is preferably 0.1% by mass or more and 3.1% by mass or less.

Ni is dispersed as an oxide of this element alone (NiO). Ni is an added element useful for contact materials having Sn and In as metal M or contact materials having Sn and Te as metal M. When the contact material contains Ni as metal M, the content of Ni is preferably 0.05% by mass or more and 1% by mass or less. The content of Sn is preferably 0.1% by mass or more and 7.85% by mass or less. In addition, for In or Te that is selectively added, it is preferable that the content of In is 0.1% by mass or more and 5% by mass or less, and the content of Te is 0.05% by mass or more and 2% by mass or less. The content of these three metals M (Sn+In+Ni or Sn+Te+Ni) is preferably 8% by mass or less. When there is a limit on design of the contact force or the opening force, it is preferable that the content of Ni is 0.05% by mass or more and 1% by mass or less, the content of Sn is 2.8% by mass or more and 5.7% by mass or less, and the content of metal M is 6% by mass or less. In this case, for In or Te that is selectively added, it is preferable that the content of In is 0.1% by mass or more and 3.1% by mass or less, and the content of Te is 0.05% by mass or more and 2% by mass or less.

When the metal components in the contact material according to the present invention includes metal M described above, and a balance including Ag and inevitable impurity metals. The inevitable impurity metals include Ca, Cu, Fe, Pb, Pd, Zn, Al, Mo, Fe, Mg, La, Li, Ge, W, Na, Zr, Nb, Y, Ta, Mn, Ti, Co, Cr, Cd, K and Si. Contents of these inevitable impurity metals are each preferably 0% by mass or more and 1% by mass or less based on the total mass of all metal components in the contact material.

As described above, the contact material that is applied in the present invention is a Ag oxide-based contact material, and contains oxygen and nonmetal impurity elements in addition to the metal components. The content of oxygen in the contact material of the present invention is 0.025% by mass or more and 2% by mass or less based on the total mass of the contact material. In addition, examples of nonmetal inevitable impurity elements include C, S and P. Contents of these inevitable impurity elements are each preferably 0% by mass or more and 0.1% by mass or less based on the total mass of the contact material. Further, the inevitable impurity metal and the nonmetal inevitable impurity element may form intermetallic compound. The intermetallic compound is assumed to be WC, TiC or the like. Contents of these intermetallic compounds are each preferably 0% by mass or more and 1% by mass or less based on the total mass of the contact material.

B-2. Material Structure of Contact Material Applied in the Present Invention

The contact material that is applied to the DC high-voltage relay of the present invention is a Ag oxide-based contact material. The material structure is basically the same as conventional Ag oxide-based contact materials. That is, the contact material has a material structure in which at least one oxide of the metal M is dispersed in a matrix including Ag and/or a Ag alloy. The matrix includes Ag (pure Ag) or a Ag alloy, or Ag and a Ag alloy. The Ag alloy is an alloy of Ag and added element M or inevitable impurity metals. The Ag alloy is not limited to a single-phase Ag alloy of one composition, and may include a plurality of Ag alloys different in amount of metal M etc. dissolved. This shows that the contact material is manufactured by internal oxidation of an alloy of Ag and metal M, a composition and a structure of the Ag alloy can vary depending on a degree of the oxidation. Thus, the matrix may contain metal M. A concentration (average concentration) of metal M in the matrix is preferably 4% by mass or less, but the contact material can be used when the upper limit of the concentration of metal M in the matrix is less than 8% by mass, for example 7% by mass or less. On the other hand, a configuration of oxide particles dispersed in the matrix is based on metal M, and at least one of oxides such as $SnO_2$, $Bi_2O_3$, $Bi_2Sn_2O_7$, $In_2O_3$, NiO and $TeO_2$ is dispersed.

As described above, in the present invention, the content of dispersed oxides (content of metal M) is intentionally reduced with respect to a conventional Ag oxide-based contact material to obtain stable low contact resistance. However, the present invention has no intention of ignoring welding resistance and mechanical strength of the material. Thus, in the present invention, by making oxide particles finer while reducing the amount of oxides, the number of oxides is increased to reduce a distance between particles, leading to enhancement of a dispersion effect. In this way, minimum material strength required for the DC high-voltage relay, and welding resistance and material strength are secured.

Material strength of the contact material that is applied in the present invention is preferably 50 Hv or more and 150 Hv or less in terms of Vickers hardness. When the material strength is less than 50 Hv, switching of the contact pair may cause deformation because the strength is excessively low. In addition, a material having a strength of 150 Hv might increase contact resistance.

In the contact material that is applied in the present invention, the average particle size of oxides dispersed in the matrix is preferably 0.01 μm or more and 0.3 μm or less. In the present invention, the content of oxides is reduced, and therefore when the average particle size of oxides is more than 0.3 μm, the distance between particles increases, so that a dispersion effect is suppressed. On the other hand, the average particle size of oxides is preferably small, but it is difficult to set the average particle size to less than 0.01 μm. In the present invention, the particle size of an oxide particle is an equivalent circular diameter (areal equivalent circular diameter), which is the diameter of a true circle having an area equivalent to the area of the particle.

In addition, in the contact material that is applied in the present invention, it is preferable that the particle sizes of dispersed oxide particles are uniform. As a criterion of this requirement, the particle size corresponding to 90% in terms of the cumulative number of particles ($D_{90}$) in a particle size distribution measured for all oxide particles by observing an arbitrary cross-section is preferably 0.5 μm or less.

In the contact material that is applied in the present invention, observation of the material structure shows that the area of oxides is relatively small because the content of the oxides is reduced. Specifically, observation of an arbitrary cross-section shows that the area ratio of oxides on the cross-section is 0.1% or more and 15% or less. The area ratio can be measured by cutting the contact material in an arbitrary direction, and observing the thus-obtained cross-section with a microscope (preferably an electron microscope) at a magnification of 1000 to 10000 times. A ratio of the total area of oxide particles in the visual field to the area of the observation visual field which is defined as the total area of the contact material may be calculated. The average particle size can be calculated in this observation. In addition, image processing software can be optionally used.

B-3. Method for Manufacturing Contact Material Applied in the Present Invention

A method for manufacturing a Ag oxide-based contact material that is applied to the DC high-voltage relay of the present invention will now be described. The contact material of the present invention can be manufactured by an internal oxidation method, a powder metallurgy method, or a combination of the internal oxidation method and the powder metallurgy method.

In the internal oxidation method, an alloy of Ag and metal M (Ag-M alloy) is produced, and subjected to internal oxidation treatment to obtain a contact material. Specific examples of the alloy manufacture here include Ag—Sn alloys (Sn: 0.2 to 8% by mass, balance: Ag), Ag—Sn—In alloys (Sn: 0.1 to 7.9% by mass, In: 0.1 to 5% by mass, balance: Ag), Ag—Sn—Bi alloys (Sn: 0.1 to 7.95% by mass, Bi: 0.05 to 2% by mass, balance: Ag), Ag—Sn—In—Bi alloys (Sn: 0.1 to 7.85% by mass, In: 0.1 to 5% by mass, Bi: 0.05 to 2% by mass, balance: Ag), Ag—Sn—Te alloys (Sn: 0.1 to 7.95% by mass, Te: 0.05 to 2% by mass, balance: Ag), Ag—Sn—In—Te alloys (Sn: 0.1 to 7.85% by mass, In: 0.1 to 5% by mass, Te: 0.05 to 2% by mass, balance: Ag), Ag—Sn—In—Ni alloys (Sn: 0.1 to 7.85% by mass, In: 0.1 to 5% by mass, Ni: 0.05 to 1% by mass, balance: Ag), and Ag—Sn—In—Te—Ni alloys (Sn: 0.1 to 7.8% by mass, In: 0.1 to 5% by mass, Te: 0.05 to 2% by mass, Ni: 0.05 to 1% by mass, balance: Ag), and these alloys can be manufactured by a known melting and casting method. A molten alloy adjusted to a desired composition is manufactured, and cast to obtain an alloy.

The alloy of Ag and metal M is internally oxidized, so that metal M is turned into an oxide to obtain a contact material. As conditions for the internal oxidation of the Ag-M alloy, the oxygen partial pressure and the temperature are 0.9 MPa or less (equal to or lower than atmospheric pressure) and 300° C. or higher and 900° C. or lower, respectively. When the oxygen partial pressure is lower than atmospheric pressure or the temperature is lower than 300° C., internal oxidation cannot proceed, and thus oxide particles cannot be dispersed in the alloy. On the other hand, when the oxygen partial pressure is more than 0.9 MPa, aggregated oxides may be precipitated. When the temperature is higher than 900° C., a part or the whole of the alloy might melt. The internal oxidation treatment time is preferably 24 hours or less.

In manufacturing of the contact material by the internal oxidation method, an alloy ingot is appropriately molded and processed, subjected to internal oxidation treatment, and appropriately molded and processed to obtain a contact material. Alternatively, an alloy ingot is formed into pieces (small pieces or chips) by crushing, cutting or the like, and the pieces are subjected to internal oxidation treatment under the above-described conditions, collected, and compression-molded into billets for processing. The manufactured billets can be subjected to appropriate processing such as extrusion processing and drawing processing, and this enables formation of a contact material having a predetermined shape and size.

In the powder metallurgy method, Ag powder and powder of oxides of metal M ($SnO_2$ powder, $In_2O_3$ powder and the like) are mixed and compressed, and then sintered to manufacture a contact material. It is preferable that the Ag powder and the oxide powder have an average particle size of 0.5 μm or more and 100 μm or less. The temperature for sintering the powder is preferably 700° C. or higher and 900° C. or lower.

In addition, the contact material can be manufactured by the internal oxidation method and the powder metallurgy method in combination. In this case, powder including an alloy of Ag and metal M (Ag-M alloy powder) is manufactured, and the alloy powder is subjected to internal oxidation treatment, and then compressed and sintered to manufacture a contact material. In the manufacturing method, the Ag-M alloy powder refers to powder including a Ag alloy having the same composition as described above (Ag—Sn alloy, Ag—Sn—In alloy, Ag—Sn—Bi alloy, Ag—Sn—In—Bi alloy, Ag—Sn—Te alloy, Ag—Sn—In—Te alloy, Ag—Sn—In—Ni alloy or Ag—Sn—In—Te—Ni alloy). It is preferable that the alloy powder has an average particle size of 100 μm or more and 3.0 mm or less. The conditions for internal oxidation of the Ag alloy powder are preferably the same conditions as described above. The temperature for sintering the Ag alloy powder is preferably 700° C. or higher and 900° C. or lower.

Advantageous Effects of the Invention

As described above, the DC high-voltage relay according to the present invention can perform reliable on/off control while coping with problems of heat generation and welding at a contact pair. The effects owe to cooperation of a high contact force and opening force set in the DC high-voltage relay and the properties of the contact material that forms the movable contact and the fixed contact.

The contact material that is applied to the DC high-voltage relay of the present invention has a daringly reduced content of dispersed oxides. Accordingly, a stable low contact resistance property is attained, and the problem of heat generation in the DC high-voltage relay is solved. In the present invention, a contact pair free from interruption failure caused by welding is formed by setting a minimum amount of oxides while utilizing the contact force and the opening force of the DC high-voltage relay.

DESCRIPTION OF EMBODIMENTS

Figure 1:
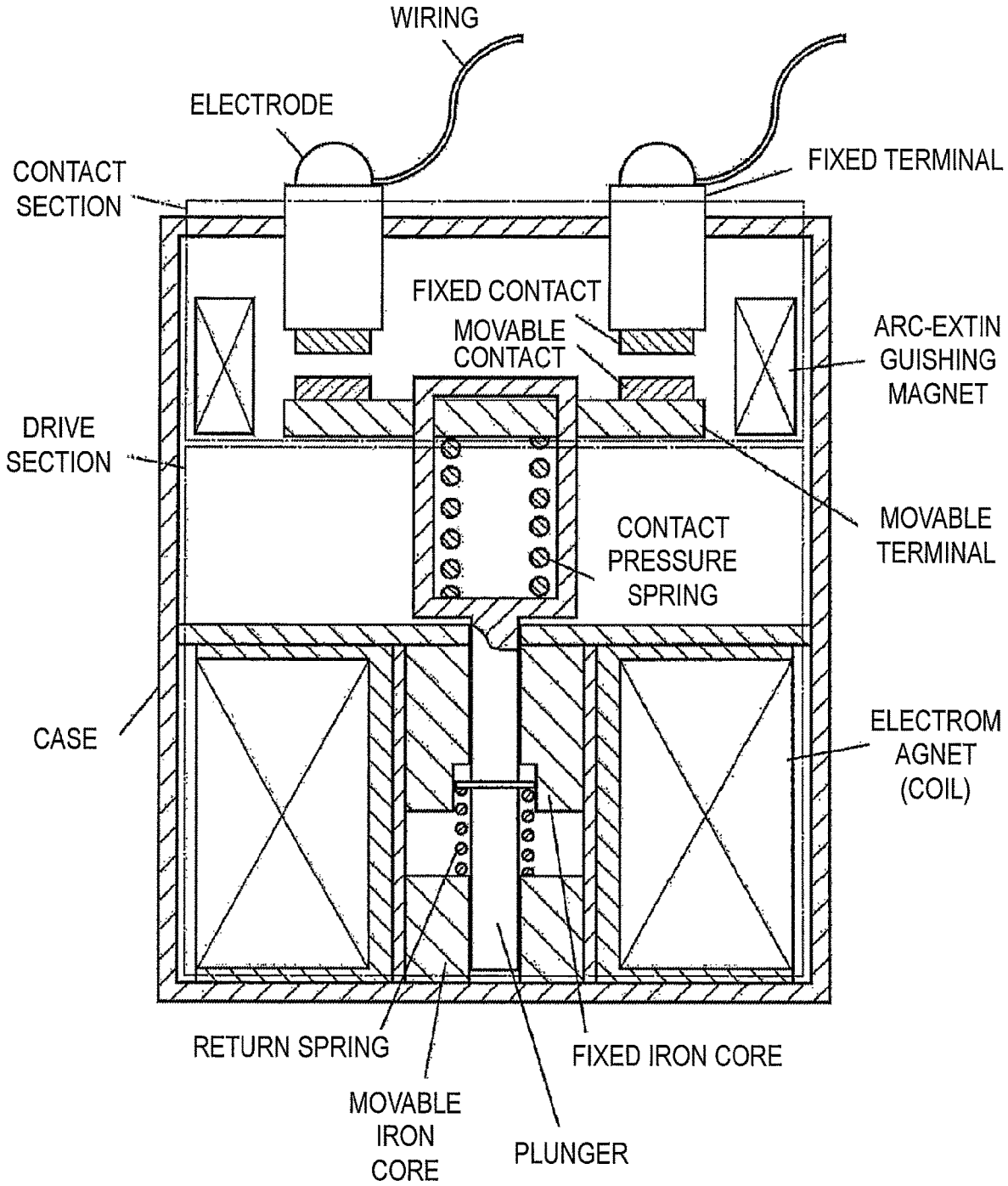
FIG. 1 is a diagram showing an example of a configuration (double-break structure) of a plunger-type DC high-voltage relay.
Figure 2:
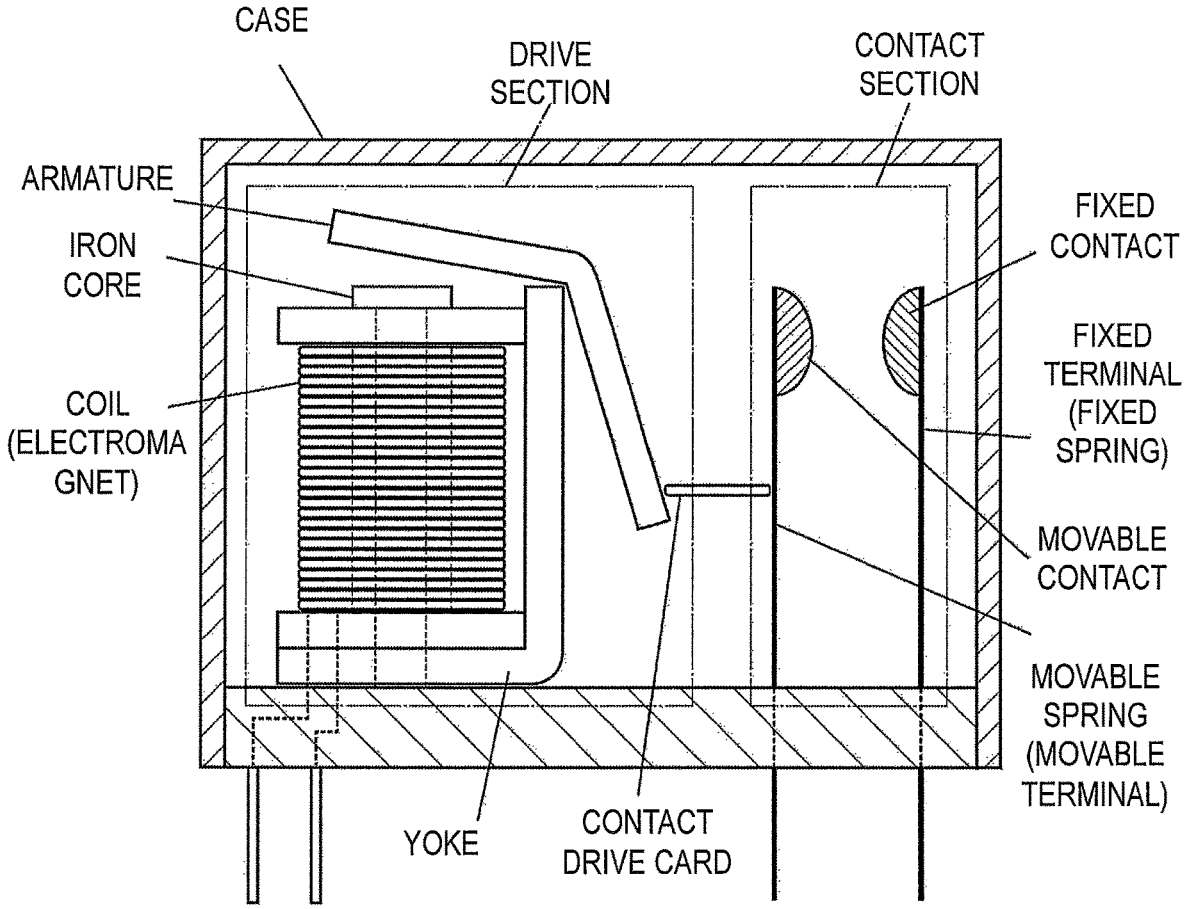
FIG. 2 is a diagram showing an example of a configuration of a hinge-type DC high-voltage relay.

Hereinafter, an embodiment of the present invention will be described. In this embodiment, metal M and compositions were adjusted to manufacture various Ag oxide-based contact materials, and structure observation and hardness measurement were performed. The manufactured Ag oxide-based contact materials were incorporated as contacts in a DC high-voltage relay, and the properties of the contact materials were evaluated.

First Embodiment: In this embodiment, various Ag oxide-based contact materials were manufactured by an internal oxidation method and a powder metallurgy method, material properties were examined, a DC high-voltage relay (contact force/opening force: 75 gf/125 gf) was then manufactured, and performance was evaluated.

In manufacturing of the contact material by the internal oxidation method, Ag alloys having various compositions were melted in a high-frequency melting furnace, and cast into an ingot. The ingot was formed into pieces of 3 mm or less, and the pieces were internally oxidized under the above-described conditions. After the internal oxidation, the pieces were collected, and compression-molded to form billets of φ 50 mm. The billets were subjected to hot extrusion processing, and subsequently subjected to drawing processing to obtain a wire rod having a diameter of 2.3 mm, and a rivet-type contact material was manufactured with a header machine. For the contact materials of Examples 15 and 27, internal oxidation treatment was performed after processing of the contact materials. In Examples 15 and 27, processing steps were carried out without internally oxidizing alloy ingots, the alloy ingots were processed into a rivet shape, then subjected to internal oxidation treatment, and appropriately molded to obtain a rivet-type contact material.

In manufacturing of the contact material by the powder metallurgy method, Ag powder and oxide powder (each having an average particle size of 0.5 to 100 μm) were mixed, and compression-molded to form billets of φ 50 mm. The manufactured billets were subjected to hot extrusion processing, and subsequently subjected to drawing processing to obtain a wire rod having a diameter of 2.3 mm, and a rivet-type contact material was manufactured with a header machine.

In this embodiment, two rivet-type contact materials, with one for a movable contact and the other for a fixed contact, were manufactured. The size of a head portion of the movable contact was set to a diameter of 3.15 mm and a height of 0.75 mm, and the size of a head portion of the fixed contact was set to a diameter of 3.3 mm and a height of 1.0 mm.

[Hardness Measurement]

In a process for manufacturing the contact materials, a wire sample was cut out from the wire rod subjected to drawing processing and annealed (temperature: 700° C.), and the hardness was measured. For hardness measurement, the sample was embedded in a resin, exposure polishing was performed so as to expose a lateral cross-section (cross-section in a short direction), and the hardness was measured with a Vickers hardness meter. For measurement conditions, the load was set to 200 gf, measurement was performed at five positions, and an average for the measurements was defined as a hardness value.

Table 1 shows the compositions and the hardness values of the contact materials of Examples (Examples 1 to 32) manufactured in this embodiment. Table 2 shows the compositions and the hardness values of the contact materials of comparative examples (Comparative Examples 1 to 10). In this embodiment, a contact material having no oxide particles and formed of pure Ag was manufactured and evaluated for comparison (Comparative Example 10). This Ag contact was manufactured by hot-extruding the melted and cast billets and performing processing etc. The hardness of the Ag contact was measured with a sample cut out after the Ag wire rod was annealed (temperature: 700° C.), and then subjected to drawing processing at a processing rate of 4.2%.

TABLE 1

| | Composition (mass %)*1 | | | | | | Hardness |
|---|---|---|---|---|---|---|---|
| | Ag | Sn | Bi | In | Ni | Te | (Hv) |
| Example 1 | Balance | 4.70 | 0.10 | — | — | — | 105 |
| Example 2 | | 4.50 | 0.30 | — | — | — | 98 |
| Example 3 | | 4.40 | 0.50 | — | — | — | 103 |
| Example 4 | | 4.00 | 0.90 | — | — | — | 92 |
| Example 5 | | 3.90 | — | 0.90 | 0.10 | — | 106 |
| Example 6 | | 3.50 | — | 1.30 | 0.10 | — | 106 |
| Example 7 | | 3.10 | — | 1.70 | 0.10 | — | 99 |
| Example 8 | | 3.20 | — | 1.30 | 0.10 | 0.30 | 95 |
| Example 9 | | 2.90 | 0.10 | — | — | — | 102 |
| Example 10 | | 2.90 | 2.00 | — | — | — | 82 |
| Example 11 | | 3.40 | 2.00 | — | — | — | 82 |
| Example 12 | | 4.00 | 2.00 | — | — | — | 77 |
| Example 13 | | 4.50 | 1.50 | — | — | — | 97 |
| Example 14 | | 4.75 | 0.05 | — | — | — | 114 |
| Example 15 | | 4.70 | 0.10 | — | — | — | 118 |
| Example 16 | | 5.90 | 0.10 | — | — | — | 114 |
| Example 17 | | 2.80 | — | 0.10 | — | — | 106 |
| Example 18 | | 2.80 | — | 3.10 | — | — | 85 |
| Example 19 | | 3.40 | — | 0.80 | — | — | 119 |
| Example 20 | | 5.00 | — | 1.00 | — | — | 98 |
| Example 21 | | 2.80 | — | 1.50 | 0.50 | — | 99 |
| Example 22 | | 2.80 | — | 1.50 | — | 1.50 | 93 |
| Example 23 | | 2.80 | — | 1.50 | 0.10 | 0.10 | 96 |
| Example 24 | | 3.00 | — | — | — | — | 108 |
| Example 25 | | 4.80 | — | — | — | — | 109 |
| Example 26 | | 6.00 | — | — | — | — | 117 |
| Example 27 | | 4.00 | — | — | — | 0.80 | 91 |
| Example 28 | | 6.00 | 2.00 | — | — | — | 81 |
| Example 29 | | 7.90 | 0.10 | — | — | — | 114 |
| Example 30 | | 5.00 | — | 2.00 | — | — | 109 |
| Example 31 | | 7.00 | — | 1.00 | — | — | 91 |
| Example 32 | | 7.50 | — | — | — | — | 116 |

The contact material of Example 31 was manufactured by the powder metallurgy method, and the contact materials of other examples were manufactured by the internal oxidation method.

*1Concentration based on all metal components

TABLE 2

| | Composition (mass %)*1 | | | | | | Hardness |
|---|---|---|---|---|---|---|---|
| | Ag | Sn | Bi | In | Ni | Te | (Hv) |
| Comparative Example 1 | Balance | 9.50 | — | — | — | — | 116 |
| Comparative Example 2 | | 10.50 | 0.90 | — | — | — | 91 |

TABLE 2-continued

| | Composition (mass %)*1 | | | | | | Hardness |
|---|---|---|---|---|---|---|---|
| | Ag | Sn | Bi | In | Ni | Te | (Hv) |
| Comparative Example 3 | | 7.40 | — | 4.00 | 0.10 | 0.50 | 98 |
| Comparative Example 4 | | 3.00 | 3.00 | — | — | — | 83 |
| Comparative Example 5 | | 5.00 | — | 4.00 | — | — | 97 |
| Comparative Example 6 | | 2.00 | — | 7.00 | — | — | 86 |
| Comparative Example 7 | | 3.40 | — | 0.80 | 0.10 | 2.50 | 75 |
| Comparative Example 8 | | 9.70 | — | — | — | — | 67 |
| Comparative Example 9 | | 3.20 | — | 1.30 | 1.50 | 2.00 | —*2 |
| Comparative Example 10 | 100 | — | — | — | — | — | 50 |

The contact materials of Comparative Examples 1 to 7 and 9 were manufactured by the internal oxidation method, and the contact material of Comparative Example 8 was manufactured by the powder metallurgy method.

The contact material of Comparative Example 10 (Ag) was manufactured by subjecting melted and cast billets to hot extrusion processing etc.

*1Concentration based on all metal components

*2Sample processing was impossible

[Structure Observation]

Next, the structures of the contact materials were observed. A transverse section of a sample embedded in a resin as in hardness measurement was observed with an electron microscope (SEM) (magnification of 5000 times). The formed SEM image was subjected to image processing by the use of particle analysis software. In the image processing, the total area (area ratio to the visual field area), the average particle size and the particle size distribution of oxides were measured and analyzed as a dispersion state of the oxides in the contact material. For the analysis, Particle Analysis System AZtecFeature made by Oxford Instruments was used. The particle size was determined in terms of an equivalent circular diameter (areal equivalent circular diameter). Based on the area f of each oxide particle, the particle size of the oxide particle was calculated from an equivalent circular diameter calculation formula ($(4f/\pi)^{1/2}$), and the average and the standard deviation a of the particle sizes were determined.

Figure 3:
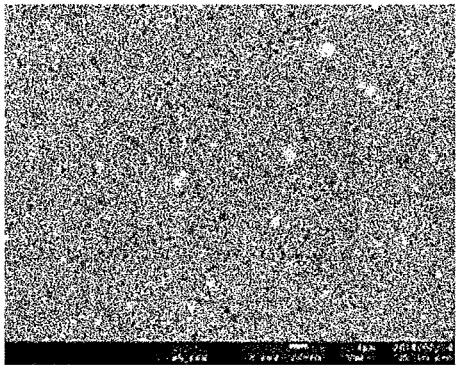
FIG. 3 shows SEM images of cross-sections of contact materials of Examples 4, 6 and 8 in a first embodiment, and Comparative Example 2.
Figure 3:
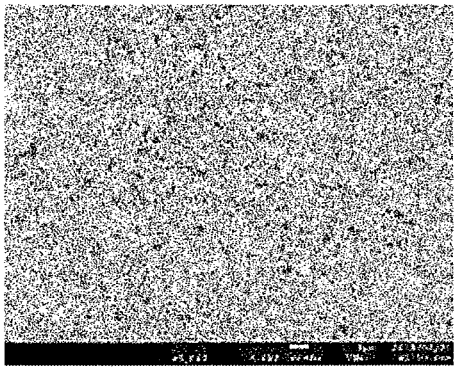
Figure 3:
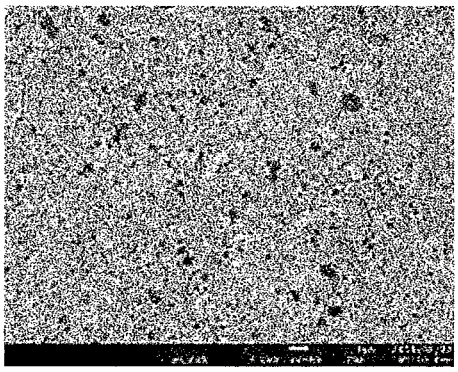
Figure 3:
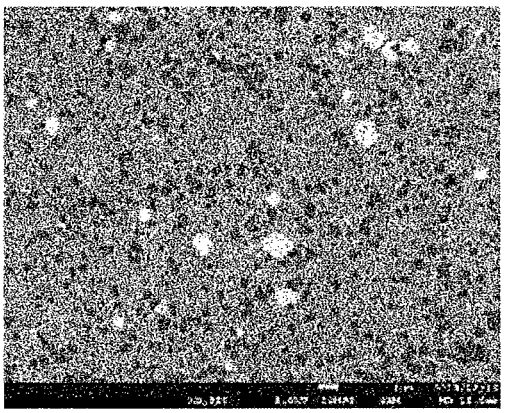

FIG. 3 shows SEM images of the contact materials of Examples 4, 6 and 8 and Comparative Example 2. Table 3 shows the states of oxide particles measured with respect to the contact materials of Examples 1 to 4, 6, 8, 9, 12 to 14, 16, 18 to 20, 23 to 26, 28, 29 and 32 and Comparative Examples 2, 3 and 8. From FIG. 3 and Table 3, it is understandable that in the contact materials of the examples, fine oxide particles are dispersed in a Ag matrix. On the other hand, in the contact materials of comparative examples, relatively coarse oxide particles are dispersed.

TABLE 3

| | Composition (mass %)*1 | | | | | | Dispersion state of oxide particles | | |
|---|---|---|---|---|---|---|---|---|---|
| | | | | | | | Area ratio | Average particle size | Particle size standard deviation σ |
| | Ag | Sn | Bi | In | Ni | Te | (%) | (μm) | (μm) |
| Example 1 | Balance | 4.70 | 0.10 | — | — | — | 9.00 | 0.098 | 0.056 |
| Example 2 | | 4.50 | 0.30 | — | — | — | 8.24 | 0.103 | 0.067 |
| Example 3 | | 4.40 | 0.50 | — | — | — | 8.63 | 0.116 | 0.079 |
| Example 4 | | 4.00 | 0.90 | — | — | — | 7.33 | 0.109 | 0.087 |
| Example 6 | | 3.50 | — | 1.30 | 0.10 | — | 6.49 | 0.044 | 0.044 |
| Example 8 | | 3.20 | — | 1.30 | 0.10 | 0.30 | 8.17 | 0.059 | 0.060 |
| Example 9 | | 2.90 | 0.10 | — | — | — | 5.77 | 0.086 | 0.043 |
| Example 12 | | 4.00 | 2.00 | — | — | — | 10.41 | 0.249 | 0.178 |
| Example 13 | | 4.50 | 1.50 | — | — | — | 9.94 | 0.222 | 0.149 |
| Example 14 | | 4.75 | 0.05 | — | — | — | 10.09 | 0.082 | 0.066 |
| Example 16 | | 5.90 | 0.10 | — | — | — | 10.83 | 0.087 | 0.072 |
| Example 18 | | 2.80 | — | 3.10 | — | — | 10.49 | 0.231 | 0.175 |
| Example 19 | | 3.40 | — | 0.80 | — | — | 6.59 | 0.066 | 0.030 |
| Example 20 | | 5.00 | — | 1.00 | — | — | 14.27 | 0.085 | 0.089 |
| Example 23 | | 2.80 | — | 1.50 | 0.10 | 0.10 | 8.39 | 0.075 | 0.059 |
| Example 24 | | 3.00 | — | — | — | — | 7.54 | 0.074 | 0.033 |
| Example 25 | | 4.80 | — | — | — | — | 9.14 | 0.084 | 0.049 |
| Example 26 | | 6.00 | — | — | — | — | 12.59 | 0.090 | 0.057 |
| Example 28 | | 6.00 | 2.00 | — | — | — | 13.94 | 0.232 | 0.179 |
| Example 29 | | 7.90 | 0.10 | — | — | — | 14.27 | 0.085 | 0.089 |
| Example 32 | | 7.50 | — | — | — | — | 8.36 | 0.060 | 0.068 |
| Comparative Example 2 | | 10.50 | 0.90 | — | — | — | 19.43 | 0.186 | 0.199 |
| Comparative Example 3 | | 7.40 | — | 4.00 | 0.10 | 0.50 | 16.17 | 0.173 | 0.152 |
| Comparative Example 8 | | 9.70 | — | — | — | — | 21.14 | 0.581 | 0.541 |

*1Concentration based on all metal components

Figure 4:
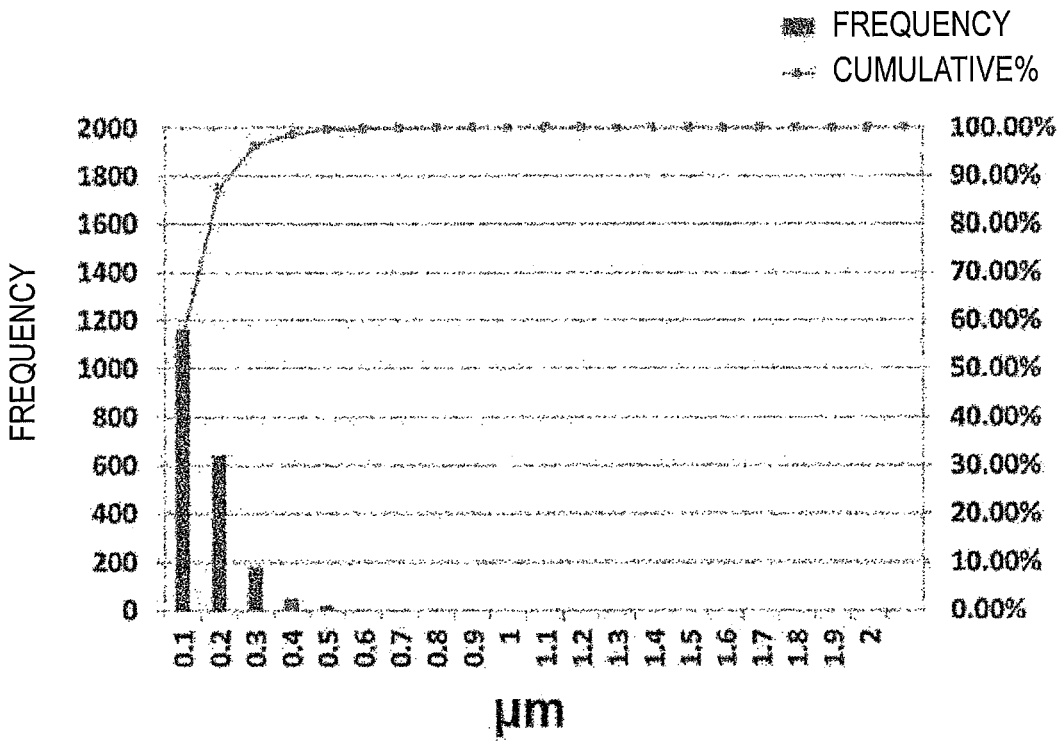
FIG. 4 is a diagram showing a particle size distribution of oxides for the contact material of Example 4 in the first embodiment.

FIG. 4 shows a particle size distribution of oxide particles in the contact material of Example 4. From FIG. 4, it is understandable that oxide particles dispersed in the contact material of the example are fine and uniform in particle size. In the particle size distribution of oxide particles of Example 4, the particle size corresponding to 90% in terms of the cumulative number of particles ($D_{90}$) is 0.2 μm or less. In other examples, particle size distributions were similarly measured, and the results showed that the particle size $D_{90}$ was 0.5 μm or less in all the examples.

[Interruption Durability Evaluation Test in DC high-Voltage Relay]

Next, DC high-voltage relays containing the contact materials of examples and comparative examples were manufactured, and tests for evaluating the properties of these DC high-voltage relays were conducted. Here, relays of the same type as in FIG. 1, which had a double-break structure, were prepared, and rivet-type contacts formed of the contact materials were bonded to movable terminals and fixed terminals of the relays (two contact pairs were formed from a total of four contacts). Regarding the size of the contact (size of the head portion of the rivet), the movable contact has a diameter of 3.15 mm and a thickness of 0.75 mm (the area of a contact surface in observation of the head portion from the upper surface is 7.79 $mm^2$), and the fixed contact has a diameter of 3.3 mm and a thickness of 1.0 mm (the area of a contact surface in observation of the head portion from the upper surface is 8.55 $mm^2$). Arc-extinguishing magnets (two neodymium magnets having a magnetic flux density of 200 mT) were disposed on the periphery of the movable contact and the fixed contact. The magnetic flux density at the central position in contacting of the contacts was 26 mT as measured with a gaussmeter.

In the test for evaluation of the DC high-voltage relay in this embodiment, an interruption operation simulating an interruption operation at the time of occurrence of abnormality was repeatedly carried out, and the number of the operations (interruptions) until interruption failure occurred due to welding of contacts was measured. The number of interruptions is a criterion showing interruption durability of the contact material, which is characterized by a relation between the contact force/opening force and the welding resistance of the relay. That is, the number of interruptions measured in this test does not give a mere assessment of welding resistance, but gives an index of usability of the relay itself. The test conditions for the interruption durability test in this embodiment were set as follows: voltage/current: DC 360 V.400 A and contact force/opening force of movable contact: 75 gf/125 gf. The setting of the contact force was adjusted by the strength of a contact pressure spring, and the setting of the opening force was adjusted by the strength of a return spring. The DC high-voltage relay used for the evaluation test has a double-break structure, the forces exerted on the contact pairs are each ½ of the force given by the contact pressure spring and the return spring. The forces exerted on the contact pairs were defined as a contact force and an opening force, respectively. In the interruption durability test, the upper limit of the number of interruptions was set to 100 times, and the measurement of a sample was ended at the time when the 100th interruption was completed. In the interruption durability test, contacts for which the number of interruptions was 50 or more times was rated acceptable. Contacts for which the number of interruptions was less than 50 times was evaluated as being unable to satisfy welding resistance required for the DC high-voltage relay. In practical use, principal interruption of the DC high-voltage relay occurs only once at the time of abnormality. Hence, the acceptance criterion which requires that the number of interruptions be 50 times in the interruption durability test is significantly high even after consideration of a margin.

For the contact material after the interruption durability test, the melting area was measured. For measurement of the melting area, a contact surface after the interruption durability test was observed from above with a digital microscope, a molten portion was surrounded by area selection, and the area of the portion was measured as the area of the contact surface by the use of a measurement function of the digital microscope. A difference between the areas before and after the durability test was determined, the difference in area was divided by the number of interruption tests of the sample, and the thus-obtained value was defined as a melting area. The melting area is an index of ease of shape collapse of a contact, which can be caused by a load at the time of interruption. Since the DC relay of double-break structure, which was used in this embodiment, had two contact pairs, a total of four contact materials were used. The measurement of the melting area was performed for the four contact materials, and the total value for the contact materials was evaluated.

[Contact Resistance/Heat Generation Measurement]

The contact resistance was measured for the contact materials of examples and comparative examples. The contact materials were incorporated in the same relay as in the above-described interruption durability test, and an interruption operation was carried out five times under the same conditions as in the interruption durability test, followed by measuring the value of contact resistance. After the five interruption operations, the contact resistance was measured with a change made to connection of the relay to a resistance measuring circuit (DC5V30A) prepared separately from the interruption test circuit. In the contact resistance measurement, a voltage drop between the terminals was measured at the time when a current (30 A) was continuously fed to the circuit for 30 minutes). A value obtained by dividing the measured voltage drop value (mV) by the fed current (30 A) was defined as the contact resistance (mΩ). In addition, a temperature rise caused by heat generation at the contact was measured in contact resistance measurement. The heat generation was measured in terms of a temperature rise at a terminal portion for connecting the relay containing the contact material to the resistance measuring circuit. In this measurement, the temperatures of two terminals used as an anode-side terminal and a cathode-side terminal were measured at the time of elapse of 30 minutes after the start of continuous feeding of a current for the contact resistance measurement described above, an average of temperature differences between the measured temperature and room temperature was defined as a temperature rise (° C.). The above measurement and evaluation of the properties with the DC high-voltage relay were performed with n=1 to 3 for each contact material, and an average in each test was defined as a measured value.

[Evaluation of Durability in DC Low-Voltage Relay Simulation Tester]

Further, for the contact materials of examples and comparative examples, durability under use conditions in a conventional in-vehicle DC low-voltage relay was evaluated. This evaluation test was performed by the steps of incorporating each contact material in a DC low-voltage relay simulation tester, allowing an actuator to switch contacts, generating an inrush current for 0.1 seconds at the time of closing the contacts to thereby weld the contacts, and reading a force separating the welded contacts with a strain gauge at the time of opening the contacts. The conditions for the test are as follows.

Test voltage: DC 14 V
Inrush current: 115 A
Load: four halogen lamps (240 W)
Contact force: 20 gf
Ambient temperature: 20° C.
Number of operations: 10000 times It can be determined that when the separating force in opening was more than 50 gf in the switching operation with the simulation tester, failure (interruption failure) resulting from welding occurred with an opening force in a conventional relay (50 gf or less). In this embodiment, durability was evaluated with a failure probability calculated from the number of measurements (10000 times) and the number of operations at which the separating force was more than 50 gf. Evaluation in the DC low-voltage relay simulation tester was performed with n=1 for each material.

Table 4 shows the results of the above interruption durability test, melting area measurement, contact resistance/heat generation measurement, and evaluation of the failure probability under use conditions for conventional relays.

TABLE 4

| | Composition (mass %)*1 | | | | | | High-voltage evaluation | | | | | | Low-voltage evaluation | |
|---|---|---|---|---|---|---|---|---|---|---|---|---|---|---|
| | | | | | | | Contact force | Opening force | Number of interruptions | Melting area | Contact resistance | Heat generation | Opening force*3 | Failure probability |
| | Ag | Sn | Bi | In | Ni | Te | (gf) | (gf) | (times) | (mm*2) | (mΩ) | (° C.) | (gf) | (%) |
| Example 1 | Balance | 4.70 | 0.10 | — | — | — | 75 | 125 | 98.67 | 0.13 | 1.86 | 22.23 | 50 | 15.91 |
| Example 2 | | 4.50 | 0.30 | — | — | — | | | 95.50 | 0.11 | 1.85 | 23.73 | | 6.30 |
| Example 3 | | 4.40 | 0.50 | — | — | — | | | 100 | 0.09 | 2.16 | 25.47 | | 11.71 |
| Example 4 | | 4.00 | 0.90 | — | — | — | | | 95.17 | 0.11 | 1.97 | 24.40 | | 14.04 |
| Example 5 | | 3.90 | — | 0.90 | 0.10 | — | | | 92.83 | 0.09 | 2.03 | 24.54 | | 8.45 |
| Example 6 | | 3.50 | — | 1.30 | 0.10 | — | | | 89.33 | 0.11 | 2.03 | 24.52 | | 9.15 |
| Example 7 | | 3.10 | — | 1.70 | 0.10 | — | | | 72.67 | 0.14 | 2.23 | 26.32 | | 3.42 |
| Example 8 | | 3.20 | — | 1.30 | 0.10 | 0.30 | | | 87.83 | 0.15 | 2.28 | 26.29 | | 10.91 |
| Example 9 | | 2.90 | 0.10 | — | — | — | | | 66.67 | 0.22 | 1.46 | 20.79 | | 13.90 |
| Example 10 | | 2.90 | 2.00 | — | — | — | | | 86.00 | 0.17 | 2.01 | 25.65 | | 21.17 |
| Example 11 | | 3.40 | 2.00 | — | — | — | | | 100 | 0.16 | 2.09 | 27.36 | | 14.31 |
| Example 12 | | 4.00 | 2.00 | — | — | — | | | 100 | 0.13 | 2.26 | 28.41 | | 10.93 |
| Example 13 | | 4.50 | 1.50 | — | — | — | | | 100 | 0.15 | 2.35 | 28.67 | | 5.72 |

TABLE 4-continued

| | Composition (mass %)*1 | | | | | | High-voltage evaluation | | | | | | Low-voltage evaluation | |
|---|---|---|---|---|---|---|---|---|---|---|---|---|---|---|
| | Ag | Sn | Bi | In | Ni | Te | Contact force (gf) | Opening force (gf) | Number of interruptions (times) | Melting area (mm*2) | Contact resistance (mΩ) | Heat generation (° C.) | Opening force*3 (gf) | Failure probability (%) |
| Example 14 | | 4.75 | 0.05 | — | — | — | | | 77.00 | 0.20 | 2.07 | 24.64 | | 11.54 |
| Example 15 | | 4.70 | 0.10 | — | — | — | | | 100 | 0.08 | 1.46 | 20.48 | | 13.69 |
| Example 16 | | 5.90 | 0.10 | — | — | — | | | 79.33 | 0.14 | 2.21 | 25.43 | | 5.68 |
| Example 17 | | 2.80 | — | 0.10 | — | — | | | 100 | 0.15 | 2.48 | 28.77 | | 25.49 |
| Example 18 | | 2.80 | — | 3.10 | — | — | | | 100 | 0.10 | 2.40 | 28.41 | | 2.44 |
| Example 19 | | 3.40 | — | 0.80 | — | — | | | 92.00 | 0.11 | 1.94 | 24.80 | | 15.45 |
| Example 20 | | 5.00 | — | 1.00 | — | — | | | 100 | 0.08 | 2.32 | 28.20 | | 7.79 |
| Example 21 | | 2.80 | — | 1.50 | 0.50 | — | | | 84.50 | 0.16 | 2.33 | 28.81 | | 2.32 |
| Example 22 | | 2.80 | — | 1.50 | — | 1.50 | | | 70.00 | 0.21 | 2.28 | 29.41 | | 6.88 |
| Example 23 | | 2.80 | — | 1.50 | 0.10 | 0.10 | | | 100 | 0.12 | 1.58 | 23.22 | | 6.52 |
| Example 24 | | 3.00 | — | — | — | — | | | 100 | 0.19 | 2.21 | 28.29 | | 16.07 |
| Example 25 | | 4.80 | — | — | — | — | | | 81.00 | 0.15 | 2.26 | 28.73 | | 21.13 |
| Example 26 | | 6.00 | — | — | — | — | | | 100 | 0.08 | 2.31 | 29.09 | | 3.43 |
| Example 27 | | 4.00 | — | — | — | 0.80 | | | 76 | 0.20 | 2.04 | 26.26 | | 1.40 |
| Example 28 | | 6.00 | 2.00 | — | — | — | | | 96.67 | 0.13 | 2.53 | 29.06 | | 0.02 |
| Example 29 | | 7.90 | 0.10 | — | — | — | | | 100 | 0.09 | 2.66 | 28.75 | | 0.77 |
| Example 30 | | 5.00 | — | 2.00 | — | — | | | 100 | 0.07 | 2.35 | 28.60 | | 4.50 |
| Example 31 | | 7.00 | — | 1.00 | — | — | | | 100 | 0.08 | 2.67 | 29.51 | | 13.40 |
| Example 32 | | 7.50 | — | — | — | — | | | 89.50 | 0.08 | 2.60 | 29.17 | | 1.39 |
| Comparative Example 1 | | 9.50 | — | — | — | — | | | 100 | 0.05 | 2.93 | 31.47 | | 0.27 |
| Comparative Example 2 | | 10.50 | 0.90 | — | — | — | | | 100 | 0.05 | 3.61 | 33.79 | | 0.00 |
| Comparative Example 3 | | 7.40 | — | 4.00 | 0.10 | 0.50 | | | 100 | 0.06 | 7.86 | 53.80 | | 0.84 |
| Comparative Example 4 | | 3.00 | 3.00 | — | — | — | | | 100 | 0.15 | 3.30 | 35.60 | | 1.60 |
| Comparative Example 5 | | 5.00 | — | 4.00 | — | — | | | 93 | 0.11 | 3.65 | 36.62 | | 1.81 |
| Comparative Example 6 | | 2.00 | — | 7.00 | — | — | | | 100 | 0.06 | 4.11 | 42.44 | | 0.00 |
| Comparative Example 7 | | 3.40 | — | 0.80 | 0.10 | 2.50 | | | 22 | 1.93 | 2.93 | 32.53 | | 4.40 |
| Comparative Example 8 | | 9.70 | — | — | — | — | | | 30 | 0.35 | 2.45 | 26.31 | | 2.42 |
| Comparative Example 9 | | 3.20 | — | 1.30 | 1.50 | 2.00 | | | —*2 | —*2 | —*2 | —*2 | | —*2 |
| Comparative Example 10 | 100 | — | — | — | — | — | | | 7.33 | 2.03. | 1.01 | 17.90 | | 21.34 |

*1Concentration based on all metal components

*2Sample processing was impossible

*3The separating force at the time of opening in switching operation with a simulation tester was set to an opening force (50 gf)

From the evaluation results shown in Table 4, it can be confirmed that the contact materials of Examples 1 to 32 have a smaller amount of dispersed oxides as compared to comparative examples, but have good welding resistance when applied to DC high-voltage relays, and hardly suffer the problems of contact resistance and heat generation.

That is the contact materials of examples in this embodiment each satisfied the criterion which requires that the number of interruptions is 50 times or more in an interruption durability test at a high-voltage. Thus, the contact materials of examples had good interruption durability. At the same time, the contact materials of examples were confirmed to have lower contact resistance as compared to comparative examples. In particular, the contact materials of Example 1 to Example 27 had a particularly low contact resistance of 2.5 mΩ or less. In addition, for each of the contact materials of Example 28 to Example 32, the number of interruptions in high-voltage evaluation is 80 times or more, and particularly good interruption durability was exhibited. The contact resistance of each of the contact materials of Example 28 to Example 32 was slightly high, but lower as compared to comparative examples.

Regarding the problem of heat generation, the results of measurement performed with the contact materials actually incorporated in the relays show superiority of the contact materials of examples. The contact materials of examples have a lower temperature rise value as compared to those of comparative examples. The amount of heat generation at contacts is proportional to a square of current and a contact resistance value. In the measurement test in this embodiment, a relatively low current of 30 A is fed, but when the fed current increases with the contact material applied to an actual DC high-voltage relay, the temperature rise further increases.

Further, for the results of evaluating the melting area, the melting area in this embodiment which is shown in Table 4 is a value obtained by dividing the total of area change amounts of the surfaces of four contacts after the interruption test by the number of interruptions at the contacts (a maximum of 100 times) as described above. That is, the melting area here means a melting area per interruption. In practical use, principal interruption of the relay occurs only once at the time of abnormality, and it is assumed to be necessary that the number of interruptions with a margin be 5 times taken into consideration. Based on this assumption, for example, the contact material of Example 9 with the largest melting area among the contact materials of Examples 1 to 32 has a melting area of 0.22 $mm^2$, and therefore five interruptions may change the area of the contact surface by 1.10 $mm^2$ (0.22 $mm^2 \times 5$). The area of the contact surface before the test in terms of a total of four contacts is 32.68 $mm^2$ (7.79 $mm^2 \times 2$ +8.55 $mm^2 \times 2$), and therefore the ratio of change of the area of the contact surface, which is caused by five interruptions, is 3.37% (1.10 $mm^2$/32.68 $mm^2$). Thus, in the contact materials of the examples, the area change at the time of interruption can be limited to 10% or less in practical use.

Metal M of the contact material that is applied in the present invention essentially has Sn, and may contain metals other than Sn (Bi, In, Ni and Te). Table 4 shows that when a contact material containing only Sn as metal M (e.g. Example 24) is set to a standard, contact materials containing Bi or the like together with Sn (e.g. Example 9 (Sn+Bi), Example 19 (Sn+In) and Example 23 (Sn+In+Ni+Te)) tend to have lower contact resistance while exhibiting good results for interruption durability and the melting area in comparison with the standard. Hence, it is confirmed that metals M other than Sn (Bi, In, Ni and Te) have an effect. A DC high-voltage relay carrying such a contact material containing a plurality of metals can also maintain required contact performance. However, it was confirmed that when a large amount of metal M other than Sn was added as in Comparative Example 9 where Ni was added a lot, processability deteriorated.

However, the results of low-voltage evaluation which gives consideration to application to conventional DC low-voltage relays show that in terms of a failure probability, the contact materials of Example 1 to Example 26, 30 and 31 are not suitable for DC low-voltage relays. This is because the contact materials of these examples tend to have a higher failure probability as compared to comparative examples. That is, the contact materials of Examples 1 to Example 26, 30 and 31 are shown to exhibit their usefulness when used in proper applications that are DC high-voltage relays. On the other hand, the contact materials of Examples 28, 29 and 32 are comparative to the contact materials of comparative examples in failure probability in low-voltage evaluation. However, the contact materials of these examples have a low contact resistance value in high-voltage evaluation, and are therefore suitable for DC high-voltage relays as well.

With respect to the contact materials of examples examined above, the contact materials of comparative examples had a large amount of oxides, and were therefore excellent in interruption durability and melting area in high-voltage evaluation. However, the contact materials of comparative examples had high values of contact resistance and heat generation. Therefore, DC high-voltage relays including the contact materials having a large amount of oxides may have the problem of heat generation at contacts.

Second Embodiment

In this embodiment, contact materials were manufactured by the internal oxidation method and the powder metallurgy method. After structure observation and hardness measurement for the materials, DC high-voltage relays (contact force/opening force: 500 gf/250 gf) were manufactured, and evaluation of durability and measurement and evaluation of contact resistance were performed. Table 5 shows contact materials manufactured in this embodiment. Table 5 also shows the results of measuring hardness measured in the same manner as in the first embodiment. The contact materials manufactured by the internal oxidation method and the powder metallurgy process in the same steps as in the first embodiment.

TABLE 5

| | Composition (mass %)*1 | | | | | | Hardness |
|---|---|---|---|---|---|---|---|
| | Ag | Sn | Bi | In | Ni | Te | (Hv) |
| Example 33 | Balance | 0.20 | — | — | — | — | 82 |
| Example 34 | | 4.80 | — | — | — | — | 76 |
| Example 35 | | 3.10 | 0.10 | — | — | — | 104 |
| Example 36 | | 4.00 | 0.90 | — | — | — | 72 |
| Example 37 | | 2.90 | 0.10 | — | — | — | 102 |
| Example 38 | | 2.90 | 2.00 | — | — | — | 82 |
| Example 39 | | 0.10 | — | 5.00 | — | — | 87 |
| Example 40 | | 1.50 | — | 3.80 | — | — | 86 |
| Example 41 | | 2.80 | — | 0.10 | — | — | 106 |
| Example 42 | | 2.80 | — | 1.50 | 0.50 | — | 99 |
| Example 43 | | 0.50 | — | — | — | — | 89 |
| Example 44 | | 1.00 | — | — | — | — | 100 |
| Example 45 | | 3.00 | — | — | — | — | 108 |
| Example 46 | | 0.10 | 0.10 | — | — | — | 52 |
| Example 47 | | 0.10 | 2.00 | — | — | — | 60 |
| Example 48 | | 0.10 | — | 0.10 | — | — | 70 |
| Example 49 | | 3.00 | — | 5.00 | — | — | 89 |
| Example 50 | | 3.00 | 0.05 | 5.00 | — | — | 86 |
| Comparative Example 3 | | 7.40 | — | 4.00 | 0.10 | 0.50 | 98 |
| Comparative Example 11 | | 0.10 | — | — | — | — | 71 |
| Comparative Example 10 | 100 | — | — | — | — | — | 50 |

The contact materials of Examples 34 and 36 were manufactured by the powder metallurgy method, and the contact materials of other examples were manufactured by the internal oxidation method.

*1Concentration based on all metal components

Figure 5:
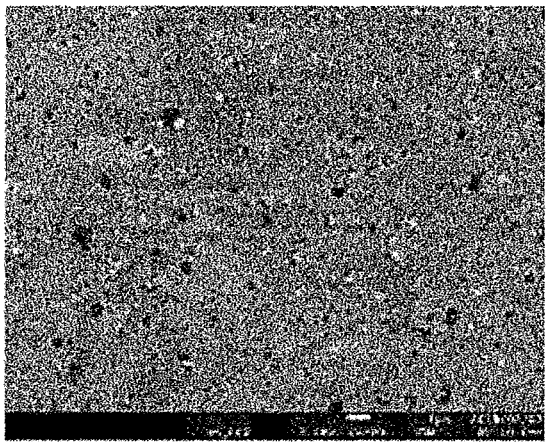
FIG. 5 is a diagram showing a SEM image of a cross-section of a contact material of Example 36 in a second embodiment, and a particle size distribution of oxide particles of the contact material.
Figure 5:
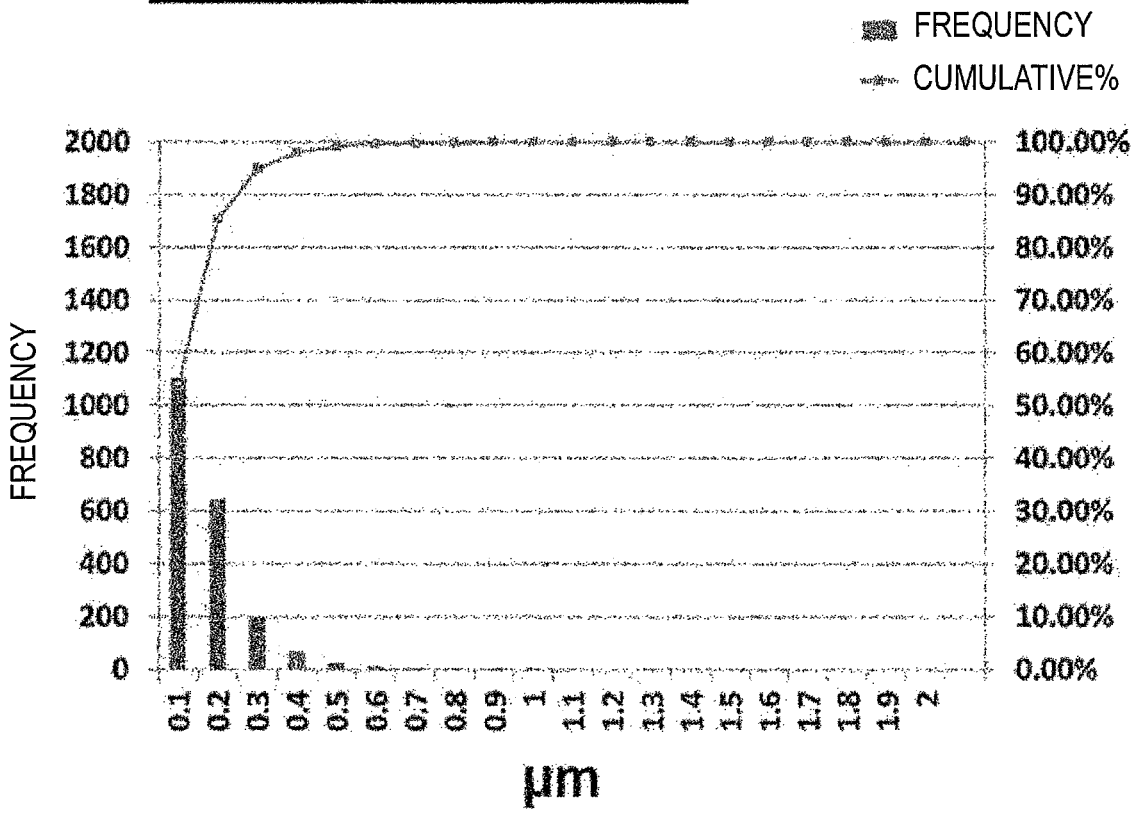

FIG. 5 is a diagram showing a SEM image of a cross-section structure of the contact material of Example 36 (contact material manufactured by the powder metallurgy method), and a particle size distribution of dispersed oxide particles of the contact material. In the contact material of Example 36, a material structure with fine oxide particles dispersed in a Ag matrix was observed. The particle size distribution diagram shows that oxide particles having a uniform particle size are dispersed. In Example 36, the average particle size was 0.113 μm (standard deviation σ: 0.101 μm), and the area ratio of particles was 8.58%. The particle size corresponding to 90% in terms of the cumulative number of particles ($D_{90}$) was 0.2 μm or less. Table 6 shows the states of oxide particles measured with respect to the contact materials of Examples 36, 39, 40, 43, 44, 47 and 49. From this table, it is understandable that in the contact materials of other examples, fine oxide particles are dispersed.

TABLE 6

| | Composition (mass %)*1 | | | | | | Dispersion state of oxide particles | | |
|---|---|---|---|---|---|---|---|---|---|
| | Ag | Sn | Bi | In | Ni | Te | Area ratio (%) | Average particle size (μm) | Particle size standard deviation σ (μm) |
| Example 36 | Balance | 4.00 | 0.90 | — | — | — | 8.58 | 0.113 | 0.101 |
| Example 39 | | 0.10 | — | 5.00 | — | — | 8.39 | 0.164 | 0.128 |
| Example 40 | | 1.50 | — | 3.80 | — | — | 7.81 | 0.149 | 0.097 |
| Example 43 | | 0.50 | — | — | — | — | 0.13 | 0.058 | 0.028 |
| Example 44 | | 1.00 | — | — | — | — | 0.23 | 0.040 | 0.015 |
| Example 47 | | 0.10 | 2.00 | — | — | — | 0.99 | 0.145 | 0.123 |
| Example 49 | | 3.00 | — | 5.00 | — | — | 12.14 | 0.219 | 0.136 |

*1Concentration based on all metal components

For the contact materials of the examples, an interruption durability test was conducted in a DC high-voltage relay. The details of the test were basically the same as in the first embodiment, and the same DC high-voltage relay of double-break structure was used. The test conditions were the same as in the first embodiment. However, the contact force/opening force of the movable contact was 500 gf/250 gf, and the contact force and the opening force were higher as compared to the first embodiment. In this embodiment, a DC high-voltage relay was manufactured in which a further sufficient contact force and opening force were set. In this interruption durability test, the number of interruptions was measured while the upper limit of the number of interruptions was set to 100.

In addition, the melting area for the contact material after the interruption durability test was measured. Further, the contact resistance values and heat generation for the contact materials were measured. The measurement methods were the same as in the first embodiment. In this embodiment, the contact materials of Comparative Examples 3 and 10 in the first embodiment were subjected to the same interruption durability test and evaluated, for comparison. Further, the interruption durability test was conducted for a contact material in which the content of metal M was below the lower limit (0.2% by mass) specified in the present invention. Table 7 shows the results of the above measurement and evaluation.

TABLE 7

| | Composition (mass %)*1 | | | | | | High-voltage evaluation | | | | | |
|---|---|---|---|---|---|---|---|---|---|---|---|---|
| | Ag | Sn | Bi | In | Ni | Te | Contact force (gf) | Opening force (gf) | Number of interruptions (times) | Melting area ($mm^2$) | Contact resistance (mΩ) | Heat generation (° C.) |
| Example 33 | Balance | 0.20 | — | — | — | — | 500 | 250 | 100 | 0.35 | 0.67 | 14.36 |
| Example 34 | | 4.80 | — | — | — | — | | | 100 | 0.20 | 1.29 | 19.66 |
| Example 35 | | 3.10 | 0.10 | — | — | — | | | 100 | 0.19 | 1.56 | 20.30 |
| Example 36 | | 4.00 | 0.90 | — | — | — | | | 100 | 0.21 | 1.77 | 21.94 |
| Example 37 | | 2.90 | 0.10 | — | — | — | | | 100 | 0.46 | 0.81 | 18.11 |
| Example 38 | | 2.90 | 2.00 | — | — | — | | | 100 | 0.34 | 0.73 | 16.66 |
| Example 39 | | 0.10 | — | 4.95 | — | — | | | 100 | 0.27 | 1.19 | 20.02 |
| Example 40 | | 1.50 | — | 3.80 | — | — | | | 100 | 0.27 | 1.25 | 20.68 |
| Example 41 | | 2.80 | — | 0.10 | — | — | | | 90 | 0.36 | 0.66 | 15.12 |
| Example 42 | | 2.80 | — | 1.50 | 0.50 | — | | | 100 | 0.27 | 1.42 | 22.31 |
| Example 43 | | 0.50 | — | — | — | — | | | 100 | 0.57 | 0.75 | 16.60 |
| Example 44 | | 1.00 | — | — | — | — | | | 100 | 0.38 | 1.25 | 21.45 |
| Example 45 | | 3.00 | — | — | — | — | | | 100 | 0.38 | 0.65 | 17.11 |
| Example 46 | | 0.10 | 0.10 | — | — | — | | | 96.00 | 0.63 | 0.67 | 16.50 |
| Example 47 | | 0.10 | 2.00 | — | — | — | | | 76.25 | 0.63 | 0.87 | 16.93 |
| Example 48 | | 0.10 | — | 0.10 | — | — | | | 100 | 0.45 | 0.61 | 14.53 |
| Example 49 | | 3.00 | — | 4.95 | — | — | | | 100 | 0.10 | 2.10 | 26.75 |
| Example 50 | | 3.00 | 0.05 | 4.95 | — | — | | | 100 | 0.12 | 2.18 | 27.35 |
| Comparative Example 3 | | 7.40 | — | 4.00 | 0.10 | 0.50 | | | 100 | 0.05 | 3.49 | 32.43 |
| Comparative Example 11 | | 0.10 | — | — | — | — | | | 81 | 1.48 | 0.60 | 15.43 |
| Comparative Example 10 | 100 | — | — | — | — | — | | | 47.50 | 2.51 | 0.65 | 15.79 |

*1Concentration based on all metal components

From Table 7, it is understandable that DC high-voltage relays including the contact materials of Example 33 to Example 50 in this embodiment have good interruption durability. The contacts of the DC high-voltage relays have low contact resistance, and are free from the heat generation problem. These relays satisfy the criterion which requires that the number of interruptions is 50 times or more. These relays have a low contact resistance of 2.5 mΩ, and a low heat generation amount. In addition, in evaluation for the melting area, evaluation of the contacts of Examples 46 and 47 with the largest melting area (0.63 $mm^2$) in the same manner as in the first embodiment shows that if interruption occurs five times, the ratio of change of the area of the contact surface is 9.6%, and thus the ratio of change of the area is limited to 10% or less.

On the other hand, the contact material of Comparative Example 3 is excellent in interruption durability and melting area as with the results in the first embodiment. However, the contact material has a high contact resistance value, and an evidently large temperature rise value in heat generation, and is therefore considered to hinder application of a DC high-voltage relay when mounted in the DC high-voltage relay.

The contact material of Comparative Example 11 is a contact material in which the content of metal M is below the lower limit (0.2% by mass) specified in the present invention. This contact material has low contact resistance, and a low heat generation amount. However, the melting area of the contact is excessively large. For the melting area (1.48 $mm^2$) in Comparative Example 11, evaluation performed in the same manner as in the first embodiment shows that provided that interruption occurs five times, the ratio of change of the area of the contact surface is 22.6%, and thus the ratio of change of the area is extremely high. When the melting area increases as described above, the contact shape markedly collapses. When the contact shape is collapsed, normal contact is not performed at a contact pair after the relay is returned, and thus contact failure occurs. This result is also observed in the contact material of Comparative Example 10 (pure Ag), and the Ag oxide contact material of Comparative Example 11 is substantially the same as pure Ag.

The contact material of Comparative Example 11 satisfies the criterion for the number of interruptions in the interruption durability test, and this is ascribable to a higher contact force and opening force as compared to the first embodiment. It is considered that when the contact force and the opening force are equivalent to the contact force and the opening force in the first embodiment, interruption failure occurs due to early welding as in Comparative Example 10. This shows that reduction of the amount of oxides in the contact material applied to the DC high-voltage relay is allowable only with limitations.

It is understandable from the results of the above examples that by optimizing the content of oxides (content of metal M) in the contact material of the contact pair in the DC high-voltage relay in which a sufficient contact force and opening force are set, excellent interruption durability is exhibited, and moreover, the problems of contact resistance and heat generation can be solved.

Third Embodiment: In the first and second embodiments, DC high-voltage relays of double-break structure containing various contact materials (FIG. 1) were manufactured, and interruption durability tests were conducted in which interruption operations at the time of abnormality were simulated. In this embodiment, switching operations in normal use with the DC high-voltage relay mounted as a system main relay for hybrid vehicles and the like were simulated, and durability was evaluated. The normal use refers to use conditions under loads from power source on/off operations in normal circuits.

Normal use conditions of the DC high-voltage relay which are intended by the present invention will be described in detail. In DC circuits for hybrid vehicles and the like, a precharge relay appropriate to an inrush current is installed for preventing damage of contacts of a system main relay by a high inrush current at the time when a power source is turned on. After the precharge relay absorbs the high inrush current, the power source of the system main relay is turned on.

Figure 6:
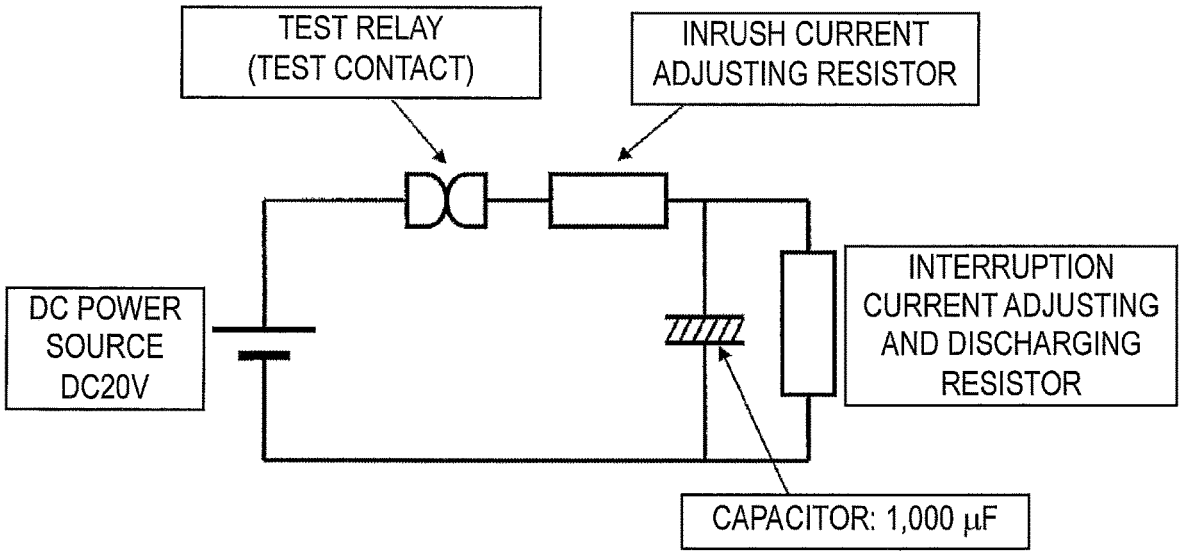
FIG. 6 is a diagram showing a circuit used in a capacitor load durability test in a third embodiment.

In this embodiment, a capacitor load durability test was conducted in which the same DC high-voltage relay as in the first and second embodiments was incorporated in a test circuit as shown in FIG. 6, and switching operations of contacts with an inrush current reduced in the manner described above were simulated. The test conditions for the capacitor load durability test in this embodiment were set as follows: voltage: DC 20 V, load current: 80 A (at the time of inrush)/1 A (at the time of interruption) and switching cycle: 1 second (on)/9 seconds (off). The contact force/opening force of the movable contact was set to 75 gf/125 gf or 500 gf/250 gf. In this capacitor load durability test, number of operations of 100,000 times was set as an acceptance criterion for durability life.

In this embodiment, the contact resistance and the temperature rise (heat generation amount) were measured as in the first and second embodiments. After the capacitor load durability test, the contact resistance was measured with a change made to connection of the relay to a resistance measuring circuit (DC5V30A) which is different from a capacitor load durability test circuit. The measurement method was the same as in the first embodiment. In addition, a temperature rise caused by heat generation at the contact was measured in the contact resistance measurement. The measurement and evaluation of the properties in this embodiment were performed with n=1 for each contact material.

Table 8 shows the results of evaluating the durability life and measuring the contact resistance and the temperature rise in the capacity load durability test in this embodiment.

TABLE 8

| | Composition (mass %)*1 | | | | | | High-voltage evaluation | | | | |
|---|---|---|---|---|---|---|---|---|---|---|---|
| | | | | | | | Contact force | Opening force | Durability | Contact resistance | Heat generation |
| | Ag | Sn | Bi | In | Ni | Te | (gf) | (gf) | life | (mΩ) | (° C.) |
| Example 1 | Balance | 4.70 | 0.10 | — | — | — | 75 | 125 | Acceptable | 1.92 | 26.64 |
| Example 4 | | 4.00 | 0.90 | — | — | — | | | Acceptable | 2.12 | 26.30 |
| Example 5 | | 3.90 | — | 0.90 | 0.10 | — | | | Acceptable | 1.94 | 25.43 |
| Example 8 | | 3.20 | — | 1.30 | 0.10 | 0.30 | | | Acceptable | 2.27 | 27.71 |
| Example 9 | | 2.90 | 0.10 | — | — | — | | | Acceptable | 1.18 | 21.76 |
| Example 10 | | 2.90 | 2.00 | — | — | — | | | Acceptable | 2.31 | 27.40 |
| Example 16 | | 5.90 | 0.10 | — | — | — | | | Acceptable | 1.41 | 22.14 |

TABLE 8-continued

| | Composition (mass %)*1 | | | | | | High-voltage evaluation | | | | |
|---|---|---|---|---|---|---|---|---|---|---|---|
| | | | | | | | Contact force | Opening force | Durability | Contact resistance | Heat generation |
| | Ag | Sn | Bi | In | Ni | Te | (gf) | (gf) | life | (mΩ) | (° C.) |
| Example 19 | | 3.40 | — | 0.80 | — | — | | | Acceptable | 1.28 | 21.47 |
| Example 23 | | 2.80 | — | 1.50 | 0.10 | 0.10 | | | Acceptable | 1.41 | 22.64 |
| Example 26 | | 6.00 | — | — | — | — | | | Acceptable | 1.74 | 23.72 |
| Example 32 | | 7.50 | — | — | — | — | | | Acceptable | 1.95 | 26.21 |
| Comparative Example 3 | | 7.40 | — | 4.00 | 0.10 | 0.50 | | | Acceptable | 6.96 | 56.57 |
| Example 33 | | 0.20 | — | — | — | — | | | Acceptable | 0.54 | 16.30 |
| Example 37 | | 2.90 | 0.10 | — | — | — | | | Acceptable | 0.91 | 17.36 |
| Comparative Example 3 | | 7.40 | — | 4.00 | 0.10 | 0.50 | 500 | 250 | Acceptable | 1.57 | 24.07 |

*1Concentration based on all metal components

Table 8 reveals that the DC high-voltage relays of examples were acceptable for the durability life in the load during normal use (number of operations: 100,000 times). In addition, the DC high-voltage relays had low contact resistance, and were acceptable for the heat generation amount. On the other hand, in the DC high-voltage relay of Comparative Example 3 with a large amount of oxides in the contact material, the contact resistance and the heat generation amount were high.

From the results of the above first to third embodiments, it was confirmed that the DC high-voltage relay according to the present invention operates suitably as a DC high-voltage relay due to optimization of the configurations of the contact materials of the movable contact and the fixed contact. The DC high-voltage relay according to the present invention can effectively operate with respect to interruption upon abnormal operations of the circuit, and stably operate in normal use.

INDUSTRIAL APPLICABILITY

The Ag oxide-based contact material that is applied in the DC high-voltage relay according to the present invention exhibits an excellent interruption durability property, has low contact resistance, and generates a small amount of heat. The DC high-voltage relay according to the present invention is free from the problems of heat generation and welding at contact pair, and can perform reliable on/off control. The present invention is suitably applied to system main relays in power source circuits of high-voltage batteries in hybrid vehicles and the like, power conditioners in power supply systems such as solar power generation equipment, and the like.

The invention claimed is:

1. A DC high-voltage relay, comprising:

a drive section which generates and transmits a drive force for moving a movable contact; and a contact section which performs switching of a DC high-voltage circuit, wherein the drive section comprises an electromagnet or a coil which generates a drive force; a transmission unit which transmits the drive force to the contact section; and a biasing unit which biases the transmission unit for closing or opening a contact pair, the contact section comprises at least one contact pair including a fixed contact and a movable contact which is moved by the transmission unit of the drive section; and at least one movable terminal bonded to the movable contact and at least one fixed terminal bonded to the fixed contact, the DC high-voltage relay has a rated voltage of 48 V or more, the contact pair has a contact force and/or opening force of 100 gf or more, the movable contact and/or the fixed contact comprises a Ag oxide-based contact material, metal components in the contact material comprise at least one metal M essentially containing Sn, and a balance being Ag and inevitable impurity metals, the contact material has a content of the metal M being 0.2% by mass or more and 8% by mass or less based on a total mass of all metal components of, and the contact material has a material structure in which one or more oxides of the metal M are dispersed in a matrix including Ag or a Ag alloy.

2. The DC high-voltage relay according to claim 1, wherein the contact material contains In as metal M, the contact material has a content of In is 0.1% by mass or more and 5% by mass or less based on a total mass of all metal components, and the contact material has a content of Sn being 0.1% by mass or more and 7.9% by mass or less based on the total mass of all metal components.

3. The DC high-voltage relay according to claim 1, wherein the contact material contains Bi as metal M, a content of Bi is 0.05% by mass or more and 2% by mass or less based on the total mass of all metal components, and the contact material has the content of Sn being 0.1% by mass or more and 7.95% by mass or less based on the total mass of all metal components.

4. The DC high-voltage relay according to claim 2, wherein the contact material contains Bi as metal M, a content of Bi is 0.05% by mass or more and 2% by mass or less based on the total mass of all metal components, and the contact material has the content of Sn being 0.1% by mass or more and 7.95% by mass or less based on the total mass of all metal components.

5. The DC high-voltage relay according to claim 1, wherein the contact material contains Te as metal M, the contact material has a content of Te being 0.05% by mass or more and 2% by mass or less based on the total mass of all metal components, and the contact material has the content of Sn being 0.1% by mass or more and 7.95% by mass or less based on the total mass of all metal components.

6. The DC high-voltage relay according to claim 2, wherein the contact material contains Te as metal M, the contact material has a content of Te being 0.05% by mass or more and 2% by mass or less based on the total mass of all metal components, and the contact material has the content of Sn being 0.1% by mass or more and 7.95% by mass or less based on the total mass of all metal components.

7. The DC high-voltage relay according to claim 2, wherein the contact material further contains Ni as metal M, the contact material has a content of Ni being 0.05% by mass or more and 1% by mass or less based on the total mass of all metal components, and the contact material has the content of Sn being 0.1% by mass or more and 7.85% by mass or less based on the total mass of all metal components.

8. The DC high-voltage relay according to claim 5, wherein the contact material further contains Ni as metal M, the contact material has a content of Ni being 0.05% by mass or more and 1% by mass or less based on the total mass of all metal components, and the contact material has the content of Sn being 0.1% by mass or more and 7.85% by mass or less based on the total mass of all metal components.

9. The DC high-voltage relay according to claim 6, wherein the contact material further contains Ni as metal M, the contact material has a content of Ni being 0.05% by mass or more and 1% by mass or less based on the total mass of all metal components, and the contact material has the content of Sn being 0.1% by mass or more and 7.85% by mass or less based on the total mass of all metal components.

10. The DC high-voltage relay according to claim 1, wherein oxides dispersed in a matrix of the contact material has an average particle size of 0.01 μm or more and 0.3 μm or less.

11. The DC high-voltage relay according to claim 2, wherein oxides dispersed in a matrix of the contact material has an average particle size of 0.01 μm or more and 0.3 μm or less.

12. The DC high-voltage relay according to claim 3, wherein oxides dispersed in a matrix of the contact material has an average particle size of 0.01 μm or more and 0.3 μm or less.

13. The DC high-voltage relay according to claim 4, wherein oxides dispersed in a matrix of the contact material has an average particle size of 0.01 μm or more and 0.3 μm or less.

14. The DC high-voltage relay according to claim 5, wherein oxides dispersed in a matrix of the contact material has an average particle size of 0.01 μm or more and 0.3 μm or less.

15. The DC high-voltage relay according to claim 6, wherein oxides dispersed in a matrix of the contact material has an average particle size of 0.01 μm or more and 0.3 μm or less.

16. The DC high-voltage relay according to claim 7, wherein oxides dispersed in a matrix of the contact material has an average particle size of 0.01 μm or more and 0.3 μm or less.

17. The DC high-voltage relay according to claim 8, wherein oxides dispersed in a matrix of the contact material has an average particle size of 0.01 μm or more and 0.3 μm or less.

18. The DC high-voltage relay according to claim 9, wherein oxides dispersed in a matrix of the contact material has an average particle size of 0.01 μm or more and 0.3 μm or less.

* * * * *